US009368103B2

(12) United States Patent
Nakano et al.

(10) Patent No.: US 9,368,103 B2
(45) Date of Patent: Jun. 14, 2016

(54) ESTIMATION SYSTEM OF SPECTRAL ENVELOPES AND GROUP DELAYS FOR SOUND ANALYSIS AND SYNTHESIS, AND AUDIO SIGNAL SYNTHESIS SYSTEM

(71) Applicant: National Institute of Advanced Industrial Science and Technology, Tokyo (JP)

(72) Inventors: Tomoyasu Nakano, Ibaraki (JP); Masataka Goto, Ibaraki (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 14/418,680

(22) PCT Filed: Jul. 30, 2013

(86) PCT No.: PCT/JP2013/070609

§ 371 (c)(1),
(2) Date: Jan. 30, 2015

(87) PCT Pub. No.: WO2014/021318

PCT Pub. Date: Feb. 6, 2014

(65) Prior Publication Data

US 2015/0302845 A1 Oct. 22, 2015

(30) Foreign Application Priority Data

Aug. 1, 2012 (JP) ..... 2012-171513

(51) Int. Cl.
*G10L 25/90* (2013.01)
*G10L 13/02* (2013.01)
(Continued)

(52) U.S. Cl.
CPC ..... *G10L 13/02* (2013.01); *G10L 21/013* (2013.01); *G10L 25/15* (2013.01); *G10L 25/18* (2013.01);
(Continued)

(58) Field of Classification Search
CPC ..... G10L 25/90; G10L 19/022; G10L 25/45
See application file for complete search history.

(56) References Cited

U.S. PATENT DOCUMENTS 5,602,959 A * 2/1997 Bergstrom ..... G10L 19/10 704/203
6,115,684 A 9/2000 Kawahara et al.
(Continued)

FOREIGN PATENT DOCUMENTS

JP 10-97287 4/1998

OTHER PUBLICATIONS

Nakatani, Tomohiro, and Toshio Irino. "Robust and accurate fundamental frequency estimation based on dominant harmonic components." The Journal of the Acoustical Society of America 116.6 (2004): 3690-3700.*
(Continued)

*Primary Examiner* — Brian Albertalli
(74) *Attorney, Agent, or Firm* — Rankin, Hill & Clark LLP

(57) ABSTRACT

For high-accuracy analysis and high-quality synthesis of voice sound (singing and speech), provided herein are a system and a method for estimating from an audio signal spectral envelopes and group delays for sound analysis and synthesis with high accuracy and high temporal resolution. An estimation system of spectral envelopes and group delays includes a fundamental frequency estimation section, an amplitude spectrum acquisition section, a group delay extraction section, a spectral envelope integration section, and a group delay integration section. The spectral envelope integration section sequentially obtains a spectral envelope for sound synthesis by averaging overlapped spectra. The group delay integration section selects from a plurality of group delays a group delay corresponding to the maximum envelope of each frequency component of the spectral envelope and integrates groups delays thus selected to sequentially obtain a group delay for sound synthesis.

20 Claims, 29 Drawing Sheets

(51) Int. Cl.

| | |
|---|---|
| ***G10L 25/18*** | (2013.01) |
| ***G10L 25/45*** | (2013.01) |
| ***G10L 25/15*** | (2013.01) |
| ***G10L 25/78*** | (2013.01) |
| ***G10L 21/013*** | (2013.01) |
| *G10L 19/022* | (2013.01) |

(52) U.S. Cl.

CPC ..... *G10L 25/45* (2013.01); *G10L 25/78* (2013.01); *G10L 25/90* (2013.01); *G10L 19/022* (2013.01); *G10L 2025/906* (2013.01)

(56) References Cited

U.S. PATENT DOCUMENTS

2012/0243705 A1* 9/2012 Bradley ..... G10L 19/00 381/94.4
2012/0265534 A1* 10/2012 Coorman ..... G10L 13/033 704/265

OTHER PUBLICATIONS

Abe, Toshihiko, Takao Kobayashi, and Satoshi Imai. "Robust pitch estimation with harmonics enhancement in noisy environments based on instantaneous frequency." Spoken Language, 1996. ICSLP 96. Proceedings., Fourth International Conference on. vol. 2. IEEE, 1996.*

Kawahara, Hideki. "Speech representation and transformation using adaptive interpolation of weighted spectrum: vocoder revisited." Acoustics, Speech, and Signal Processing, 1997. ICASSP-97., 1997 IEEE International Conference on. vol. 2. IEEE, 1997.*

Duncan, G., B. Yegnarayana, and Hema A. Murthy. "A nonparametric method of formant estimation using group delay spectra." Acoustics, Speech, and Signal Processing, 1989. ICASSP-89., 1989 International Conference on. IEEE, 1989.*

Blauert, J., and P. Laws. "Group delay distortions in electroacoustical systems." The Journal of the Acoustical Society of America 63.5 (1978): 1478-1483.*

Klatt, D.H.: "Software for a Cascade/parallel Formant Synthesizer", J. Acoust. Soc. Am., vol. 67, pp. 971-995 (1980).

Goto, M. and Nishimura, T.: "AIST Humming Database: Music Database for Singing Research", IPSJ, SIG Technical Report, 2005-MUS-61, pp. 7-12 (2005).

Goto, M., Hashimoto, H., Nishimura, T. and Oka, R.: "RWC Music Database: Database of Copyright-cleared Musical Pieces and Instrument Sounds for Research Purposes", IPSJ, Transaction vol. 45, No. 3, pp. 728-738 (2004).

Fujihara, H., Goto, M. and Okuno, H.G: "A Novel Framework for Recognizing Phonemes of Singing Voice in Polyphonic Music", Proc. WASPAA2009, pp. 17-20 (2009).

Toda, T. and Tokuda, K.: "Statistical Approach to Vocal Tract Transfer Function Estimation Based on Factor Analyzed Trajectory HMM", Proc. ICASSP2008, pp. 3925-3928 (2008).

Shiga, Y. and King, S.: "Estimating the Spectral Envelope of Voiced Speech Using Multi-frame Analysis", Proc. EUROSPEECH2003, pp. 1737-1740 (2003).

Akamine, M. and Kagoshima, T.: "Analytic Generation of Synthesis Units by Closed Loop Training for Totally Speaker Driven Text to Tpeech System ((TOS Drive TTS)", Proc. ICSLP1998, pp. 1927-1930 (1998).

Kameoka, H., Ono, N. and Sagayama, S.: "Speech Spectrum Modeling for Joint Estimation of Spectral Envelope and Fundamental Frequency", IEEE Transactions on Audio, Speech, and Language Processing vol. 18, No. 6, pp. 1507-1516 (2010).

Zolfaghari, R, Watanabe, S. Nakamura, A. and Katagiri, S.: "Bayesian Modelling of the Speech Spectrum Using Mixture of Gaussians", Proc. ICASSP 2004, pp. 553-556 (2004).

Banno, H., Lu, J., Nakamura, S., Shikano, K. and Kawahara, H.: "Speech Manipulation Method Using Phase Manipulation Based on Time-Domain Smoothed Group Delay", IEICE, Journal vol. J83-D-11, pp. 2276-2282 (2000).

Banno, H., Lu, J., Nakamura, S., Shikano, K. and Kawahara, H.: "Efficient Representation of Short-Time Phase Based on Time-Domain Smoothed Group Delay", IEICE, Journal vol. J84-D-II, No. 4, pp. 621-628 (2001).

Morise, M: Platinum: "A Method to Extract Excitation Signals for Voice Synthesis System", Acoust. Sci. & Tech., vol. 33, No. 2, pp. 123-125 (2012).

Morise, M., Matsubara, T., Nakano, K. and Nishiura, T: "A Rapid Spectrum Envelope Estimation Technique of Vowel for High-Quality Speech Synthesis", IEICE, Journal vol. J94-D, No. 7, pp. 1079-1087 (2011).

Akagiri, H., Morise, M., Irino, T. and Kawahara, H.,: Evaluation and Optimization of FO-Adaptive Spectral Envelope Extraction Based on Special Smoothing with Peak Emphasis, IEICE, Journal, vol. J94-A, No. 8, pp. 557-567 (2011).

Kawahara, H., Morise, M., Takahashi, T., Nishimura, R., Irino, T. and Banno, H.: Tandem Straight: A Temporally Stable Power Spectral Representation for Periodic Signals and Applications to Interference-free Spectrum, FO, and Aperiodicity Estimation, Proc. of ICASSP 2008, pp. 3933-3936 (2008).

Kawahara, H., Masuda-Katsuse, I. and De Cheveigne, A.: Restructuring Speech Representations Using a Pitch Adaptive Time-frequency Smoothing and an Instantaneous-Frequency-Based on FO Extraction: Possible Role of a Repetitive Structure in Sounds, Speech Communication, vol. 27, pp. 187-207 (1990).

Kameoka, H. Ono, N. and Sagayama, S.: "Auxiliary Function Approach to Parameter Estimation of Constrained Sinusoidal Model for Monaural SpeechSeparation", Proc. ICASSP 2008, pp. 29-32 (2008).

Pavlovets, A. and Petrovsky, A.: "Robust HNR-based Closed-loop Pitch and Harmonic Parameters Estimation", Proc. INTERSPEECH2O11, pp. 1981-1984 (2011).

Ito, M. and Yano, M.: "Sinusoidal Modeling for Nonstationary Voiced Speech based on a Local Vector Transform", J. Acoust. Soc. Am., vol. 121, No. 3, pp. 1717-1727 (2007).

Bonada, J.: "Wide-Band Harmonic Sinusoidal Modeling", Proc. DAFx-08, pp. 265-272 (2008).

Abe, M. and Smith III, J.O.: "Design Criteria for Simple Sinusoidal Parameter Estimation based on Quadratic Interpolation of FFT Magnitude Peaks", Proc. AES 117th Convention (2004).

Pantazis, Y., Rosec, O. and Stylianou, Y.: "Iterative Estimation of Sinusoidal Signal Parameters", IEEE Signal Processing Letters, vol. 17, No. 5, pp. 461-464 (2010).

George, E. and Smith, M.: "Analysis-by-Synthesis/Overlap—Add Sinusoidal Modeling Applied to the Analysis and Synthesis of Musical Tones", Journal of the Audio Engineering Society, vol. 40, No. 6, pp. 497-515 (1992).

Depalle, P. and H'Elie, T.: "Extraction of Spectral Peak Parameters Using a Short-time Fourier Transform Modeling and No Sidelobe Windows", Proc. WASPAA1997 (1997).

Stylianou, Y.: "Harmonic plus Noise Models for Speech, combined with Statistical Methods, for Speech and Speaker Modification", Phd Thesis.

Serra, X. and Smith, J.: "Spectral Modeling Synthesis: a Sound Analysis/Synthesis Based on a Deterministic Plus Stochastic Decomposition", Computer Music Journal, vol. 14, No. 4, pp. 12-24 (1990).

Smith, J. and Serra, X.: "PARSHL: an Analysis/Synthesis Program for Non-harmonic Sounds Based on a Sinusoidal Representation", Proc. ICMC 1987, pp. 290-297 (1987).

McAulay, R. and Quatieri, T.: "Speech Analysis/Synthesis Based on a Sinusoidal Representation", IEEE Trans. ASSP, vol. 34, No. 4, pp. 744-755 (1986).

Moulines, E. and Charpentier, F.: "Pitch-synchronous Waveform Processing Techniques for Text-to-speech Synthesis Using Diphones", Speech Sommunication, vol. 9, No. 5-6, pp. 453-467 (1990).

Villavicencio, F., Robel, A. and Rodet, X.: "Improving LPC Spectral Envelope Extraction of Voiced Speech by True-Envelope Estimation", Proc. ICASSP2006, pp. 869-872 (2006).

Villavicencio, F., Robel, A. and Roidet, X.: "Extending Efficient Spectral Envelope Modeling to Mel-frequency Based Representation", Proc. ICASSP2008, pp. 1625-1628 (2008).

(56) References Cited

OTHER PUBLICATIONS

Robel, A. and Rodet, X.: "Efficient Spectral Envelope Estimation and Its Application to Pitch Shifting and Envelope Preservation", Proc. DAFx2005, pp. 30-35 (2005).
Imai, S. and Abe, Y.: "Spectral Envelope Extraction by Improved Cepstral Methods", IEICE, Journal, vol. J62-A, No. 4, pp. 217-223 (1979).
Tokuda, K., Kobayashi, T., Masuko, T. and Imai, S.: "Melgeneralized Cepstral Analysis—A Unified Approach to Speech Spectral Estimation", Proc. ICSLP1994, pp. 1043-1045 (1994).
Atal, B.S. and Hanauer, S.: "Speech Analysis and Synthesis by Linear Prediction of the Speech Wave", J. Acoust. Soc. Am., vol. 50, No. 4, pp. 637-655 (1971).
Itakura, F. and Saito, S.: "Analysis Synthesis Telephony based on the Maximum Likelihood Method", Reports of the 6th Int. Cong. on Acoustics., vol. 2, No. C-5-5, pp. C17-C20 (1968).
Griffin, D. W.: "Multi-Band Excitation Vocoder", RLE Technical Report 524, Massachusetts Institute of Technology, Research Laboratory of Electronics (1987).
Flanagan, J. and Golden, R.M., "Phase Vocoder", Bell System Technical Journal, vol. 45, pp. 1493-1509 (1966).
Hamagami, T.: "Speech Synthesis Using Source Wave Shape Modification Technique by Harmonic Phase Control", Acoustical Society of Japan, Journal, vol. 54, No. 9, pp. 623-631 (1998).
Matsubara, T., Morise, M. and Nishiura, T.: "Perceptual Effect of Phase Characteristics of the Voiced Sound in High-Quality Speech Synthesis", Acoustical Society of Japan, Technical Committee of Psychological and Physiological Acoustics Papers, vol. 40, No. 8, pp. 653-658 (2010).
Ito, M. and Yano, M.: "Perceptual Naturalness of Time-scale Modified Speech", IEICE Technical Report EA2007-114, pp. 13-18 (2008).
Zolzer, U. and Amatriain, X.: "DAFX—Digital Audio Effects", Wiley (2002).
Lin K-S, et al: "Speech Applications with a General Purpose Digital Signal Processor", Proceedings of the Region 5 Conference (Mar. 1985).
Banno, Hideki, et al: "Efficient Representation of Short-Time Phase Based on Group Delay", The Transactions of the Institute of Electronics, Information and Communication Engineers, vol. J84-D-II(Apr. 2001).
Kawahara, H, et al: "Restructuring Speech Representations Using a Pitch-Adaptive Time-Frequency Smoothing and an Instantaneous-Based F0 Extraction: Possible Role of a Repetitive Structure in Sounds", Speech Communication Elsevier Science Publishers, Amsterdam NL, vol. 27, No. 3-4 (Apr. 1999).
European Search Report dated Feb. 12, 2016.

* cited by examiner

*Fig.12*
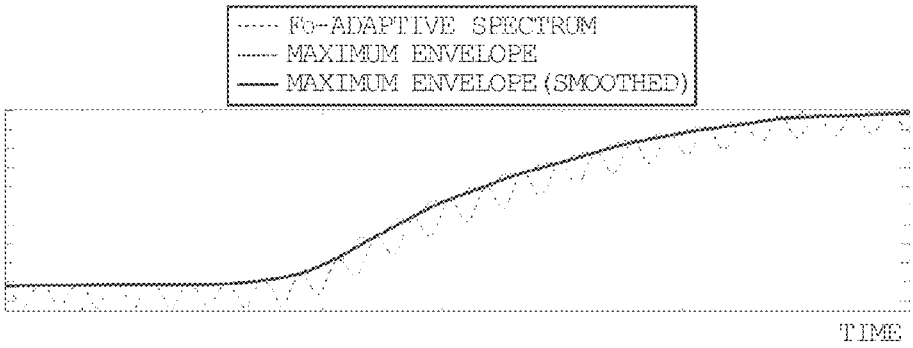
*Fig.13A*
*Fig.13B*
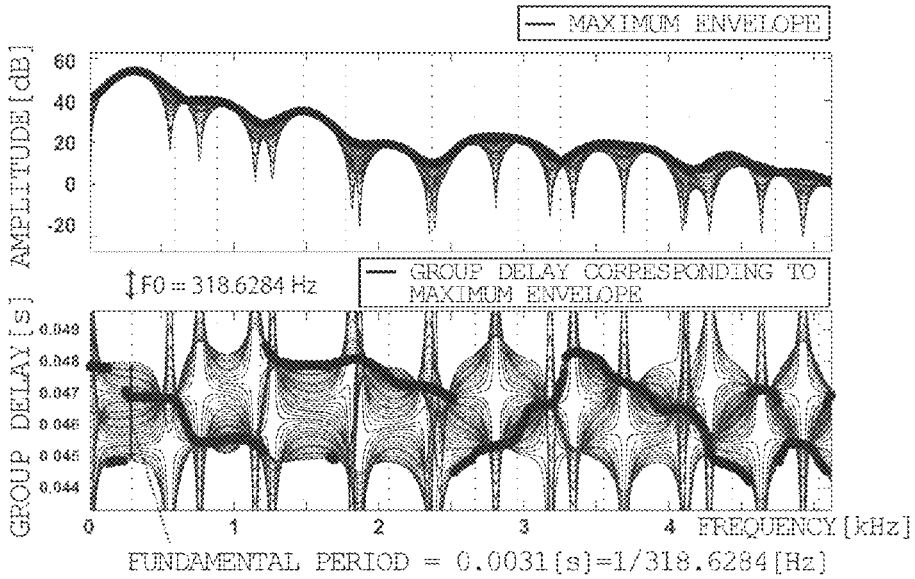

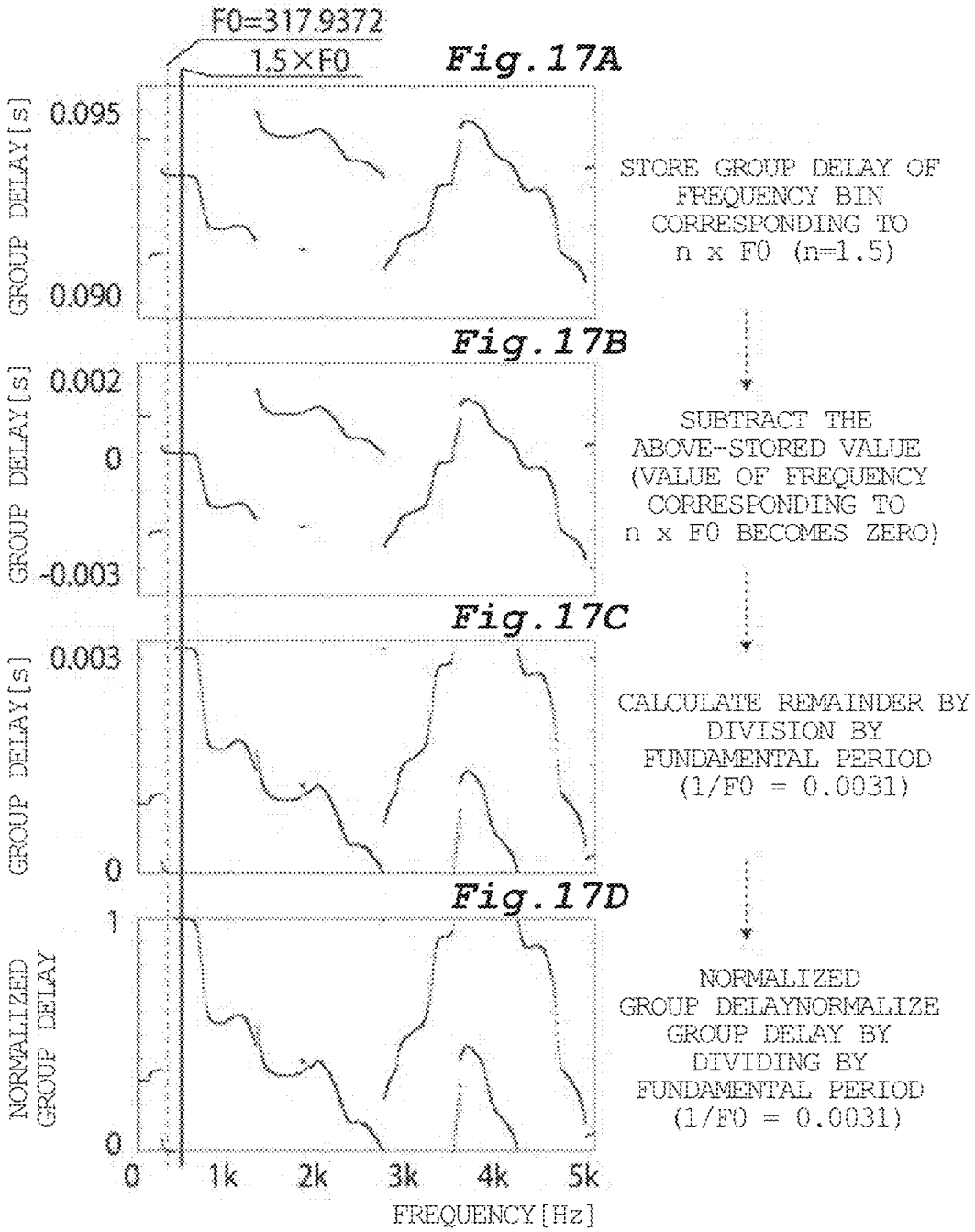
F0=317.9372
1.5×F0
Fig.17A
GROUP DELAY [s]
0.095
0.090
STORE GROUP DELAY OF FREQUENCY BIN CORRESPONDING TO n x F0 (n=1.5)
Fig.17B
GROUP DELAY [s]
0.002
0
-0.003
SUBTRACT THE ABOVE-STORED VALUE (VALUE OF FREQUENCY CORRESPONDING TO n x F0 BECOMES ZERO)
Fig.17C
GROUP DELAY [s]
0.003
0
CALCULATE REMAINDER BY DIVISION BY FUNDAMENTAL PERIOD (1/F0 = 0.0031)
Fig.17D
NORMALIZED GROUP DELAY
1
0
NORMALIZED GROUP DELAYNORMALIZE GROUP DELAY BY DIVIDING BY FUNDAMENTAL PERIOD (1/F0 = 0.0031)
0
1k
2k
3k
4k
5k
FREQUENCY [Hz]

ESTIMATION SYSTEM OF SPECTRAL ENVELOPES AND GROUP DELAYS FOR SOUND ANALYSIS AND SYNTHESIS, AND AUDIO SIGNAL SYNTHESIS SYSTEM

TECHNICAL FIELD

The present invention relates to an estimation system of spectral envelopes and group delays, and to an audio signal synthesis system.

BACKGROUND ART

Many studies have been made on estimation of spectral envelopes, but estimating an appropriate envelope is still difficult. There have been some studies on application of group delays to sound synthesis, and such application needs time information called pitch marks.

For example, source-filter analysis (Non-Patent Document 1) is an important way to deal with human sounds (singing and speech) and instrumental sounds. An appropriate spectral envelope obtained from an audio signal (an observed signal) can be useful in a wide application such as high-accuracy sound analysis and high-quality sound synthesis and transformation. If phase information (group delays) can appropriately be estimated in addition to an estimated spectral envelope, naturalness of synthesized sounds can be improved.

In the field of sound analysis, great importance has been put on amplitude spectrum information, but little focus on phase information (group delays). In sound synthesis, however, the phase plays an important role for perceived naturalness. In sinusoidal synthesis, for example, if an initial phase is shifted from natural utterance more than $\pi/8$, perceived naturalness is known to be reduced monotonically according to the magnitude of shifting (Non-Patent Document 2). Also, in sound analysis and synthesis, the minimum phase response is known to have better naturalness than the zero-phase response in obtaining an impulse response from a spectral envelope to define a unit waveform (a waveform for one period) (Non-Patent Document 3). Further, there have been studies on phase control of unit waveform for improved naturalness (Non-Patent Document 4).

Further, many studies have been made on signal modeling for high-quality synthesis and transformation of audio signals. Some of the studies do not use supplemental information, some of them are accompanied by F0 estimation as supplemental information, and others need phoneme labels. As a typical technique, the Phase Vocoder (Non-Patent Documents 5 and 6) deals with input signals in the form of power spectrogram on the time-frequency domain. This technique enables temporal expansion and contraction of periodic signals, but suffers from reduced quality due to aperiodicity and F0 fluctuation.

In addition, LPC (Linear Predictive Coding) analysis (Non-Patent Documents 7 and 8) and cepstrum are widely known as conventional techniques for spectral envelope estimation. Various modifications and combinations of these techniques have been proposed (Non-Patent Documents 9 to 13). Since the contour of the envelope is determined by the order of analysis in LPC or cepstrum, the envelope cannot appropriately be represented in some order of analysis.

In PSOLA (Pitch Synchronized Overlap-Add) (Non-Patent Documents 1 and 14) known as a conventional F0-adaptive analysis technique, estimated F0 is used as supplemental information. Time-domain waveforms are cut-out as unit waveforms based on pitch marks, and the unit waveforms thus cut out are overlap-added in a fundamental period. This technique can deal with changing F0 and stored phase information helps provide high-quality sound synthesis. This technique still has problems such as difficult pitch mark allocation as well as F0 change and reduced quality of non-stationary sound.

Also in sinusoidal models of voice and music signals (Non-Patent Documents 15 and 16), F0 estimation is used for modeling the harmonic structure. Many extensions of these models have been proposed such as modeling of harmonic components and broadband components (noise, etc.) (Non-Patent Documents 17 and 18), estimation from the spectrogram (Non-Patent Document 19), iterative estimation of parameters (Non-Patent Documents 20 and 21), estimation based on quadratic interpolation (Non-Patent Document 22), improved temporal resolution (Non-Patent Document 23), estimation of non-stationary sounds (Non-Patent Documents 24 and 25), and estimation of overlapped sounds (Non-Patent Document 26). Most of these sinusoidal models can provide high-quality sound synthesis since they use phase estimation, and some of them has high temporal resolution (Non-Patent Documents 23 and 24).

STRAIGHT, a system (VOCODER) based on source-filter analysis incorporates F0-adaptive analysis and is widely used in the speech research community throughout the world for its high-quality sound analysis and synthesis. In STRAIGHT, the spectral envelope can be obtained with periodicity being removed from an input audio signal by F0-adaptive smoothing and other processing. The system provides high-quality and has high temporal resolution. Extensions of this system are TANDEM STRAIGHT (Non-Patent Document 28) which eliminates temporal fluctuations by use of tandem windows, emphasis placed on spectral peaks (Non-Patent Document 29), and fast calculation (Non-Patent Document 30). In the STRAIGHT system and these extensions, the following techniques, for example, are introduced to attempt to improve naturalness of synthesized sounds: the mixed mode excitation with Gaussian noise convoluted with non-periodic components (defined as components which cannot be represented by the sum of harmonics or response driven by periodic pulse trains) without estimating the original phase, and the group delay randomization in the high frequency range. However, the standards for phase manipulation have not been established. Further, excitation extraction (Non-Patent Document 31) extracts excitation signals by deconvolution of the original audio signal and impulse response waveforms of the estimated envelope. It cannot be said that this technique efficiently represents the phase and it is difficult to apply the technique to interpolation and conversion. Some studies on sound analysis and synthesis (Non-Patent Documents 32 and 33), which estimate and smooth group delays, need pitch marks.

In addition to the foregoing studies, there are some studies such as Gaussian mixture modeling (GMM) of the spectral envelope, STRAIGHT spectral envelope modeling (Non-Patent Document 34), and formulated joint estimation of F0 and spectral envelope (Non-Patent Document 35).

Common problems to the studies described so far are: the analysis is limited by local observation and only the harmonic structure (frequency components of integer multiple of F0) is modeled, and transfer functions between adjacent harmonics can be obtained only with interpolation.

Further, some studies utilize phoneme labels as supplemental information. For example, attempts have been made to estimate a true envelope by integrating spectra at different F0 (different frames) using the same phoneme as the time of analysis for the purpose of estimating unobservable envelope components between harmonics (Non-Patent Documents 36 through 38). One of such studies is directed not to a single sound but to vocal in a music audio signal (Non-Patent Document 39). This study assumes that the same phoneme has a similar vocal tract shape. In this case, accurate phoneme labels are required. Furthermore, if target sound such as singing voice fluctuates largely depending upon the context, it may lead to excessive smoothing.

JP10-97287A (Patent Document 1) discloses an invention comprising the steps of: convoluting a phase adjusting component with a random number and band limit function on the frequency domain to obtain a band limited random number; multiplying a target value of delay time fluctuation by the band limited random number to obtain group delay characteristics; calculating an integral of the group delays with frequency to obtain phase characteristics; and multiplying the phase characteristics by an imaginary unit to obtain an exponent of exponential function, thereby obtaining phase adjust components.

RELATED ART DOCUMENTS

Patent Document

Patent Document 1: JP10-97287A

Non-Patent Documents

Non-Patent Document 1: Zolzer, U. and Amatriain, X., "DAFX—Digital Audio Effects", Wiley (2002).

Non-Patent Document 2: Ito, M. and Yano, M., "Perceptual Naturalness of Time-Scale Modified Speech", IEICE (The Institute of Electronics, Information and Communication Engineer) Technical Report EA, pp. 13-18 (2008).

Non-Patent document 3: Matsubara, T., Morise, M. and Nishiura, T, "Perceptual Effect of Phase Characteristics of the Voiced Sound in High-Quality Speech Synthesis", Acoustical Society of Japan, Technical Committee of Psychological and Physiological Acoustics Papers, Vol. 40, No. 8, pp. 653-658 (2010).

Non-Patent Document 4: Hamagami, T., "Speech Synthesis Using Source Wave Shape Modification Technique by Harmonic Phase Control", Acoustical Society of Japan, Journal, Vol. 54, No. 9, pp. 623-631 (1998).

Non-Patent Document 5: Flanagan, J. and Golden, R., "Phase Vocoder, Bell System Technical Journal", Vol. 45, pp. 1493-1509 (1966).

Non-Patent Document 6: Griffin, D. W., "Multi-Band Excitation Vocoder, Technical report (Massachusetts institute of Technology", Research Laboratory of Electronics) (1987).

Non-Patent Document 7: Itakura, F. and Saito, S., "Analysis Synthesis Telephony based on the Maximum Likelihood Method", Reports of the 6th Int. Cong. on Acoust., vol. 2, no. C-5-5, pp. C17-20 (1968).

Non-Patent Document 8: Atal, B. S. and Hanauer, S., "Speech Analysis and Synthesis by Linear Prediction of the Speech Wave", J. Acoust. Soc. Am., Vol. 50, No. 4, pp. 637-655 (1971).

Non-Patent Document 9: Tokuda, K., Kobayashi, T., Masuko, T. and Imai, S., "Melgeneralized Cepstral Analysis—A Unified Approach to Speech Spectral Estimation", Proc. ICSLP1994, pp. 1043-1045 (1994).

Non-Patent Document 10: Imai, S., and Abe, Y., "Spectral Envelope Extraction by Improved Cepstral Method", IEICE, Journal, Vol. J62-A, No. 4, pp. 217-223 (1979).

Non-Patent Document 11: Robel, A. and Rodet, X., "Efficient Spectral Envelope Estimation and Its Application to Pitch Shifting and Envelope Preservation", Proc. DAFx2005, pp. 30-35 (2005).

Non-Patent Document 12: Villavicencio, F., Robel, A. and Rodet, X., "Extending Efficient Spectral Envelope Modeling to Mel-frequency Based Representation", Proc. ICASSP2008, pp. 1625-1628 (2008).

Non-Patent Document 13: Villavicencio, F., Robel, A. and Rodet, X., "Improving LPC Spectral Envelope Extraction of Voiced Speech by True-Envelope Estimation", Proc. ICASSP2006, pp. 869-872 (2006).

Non-Patent Document 14: Moulines, E. and Charpentier, F., "Pitch-synchronous Waveform Processing Techniques for Text-to-speech Synthesis Using Diphones", Speech Communication, Vol. 9, No. 5-6, pp. 453-467 (1990).

Non-Patent Document 15: McAulay, R. and T. Quatieri, "Speech Analysis/Synthesis Based on A Sinusoidal Representation", IEEE Trans. ASSP, Vol. 34, No. 4, pp. 744-755 (1986).

Non-Patent Document 16: Smith, J. and Serra, X., "PARSHL: An Analysis/Synthesis Program for Non-harmonic Sounds Based on A Sinusoidal Representation", Proc. ICMC 1987, pp. 290-297 (1987).

Non-Patent Document 17: Serra, X. and Smith, J., "Spectral Modeling Synthesis: A Sound Analysis/Synthesis Based on A Deterministic Plus Stochastic Decomposition", Computer Music Journal, Vol. 14, No. 4, pp. 12-24 (1990).

Non-Patent Document 18: Stylianou, Y., "Harmonic plus Noise Models for Speech, combined with Statistical Methods, for Speech and Speaker Modification", Ph.D. Thesis, Ecole NationaleSupèrieure des Télécommunications, Paris, France (1996).

Non-Patent Document 19: Depalle, P. and H'elie, T., "Extraction of Spectral Peak Parameters Using a Short-time Fourier Transform Modeling and No Sidelobe Windows", Proc. WASPAA1997 (1997).

Non-Patent Document 20: George, E. and Smith, M., "Analysis-by-Synthesis/Overlap-Add Sinusoidal Modeling Applied to The Analysis and Synthesis of Musical Tones", Journal of the Audio Engineering Society, Vol. 40, No. 6, pp. 497-515 (1992).

Non-Patent Document 21: Pantazis, Y., Rosec, O. and Stylianou, Y., "Iterative Estimation of Sinusoidal Signal Parameters", IEEE Signal Processing Letters, Vol. 17, No. 5, pp. 461-464 (2010).

Non-Patent Document 22: Abe, M. and Smith III, J. O., "Design Criteria for Simple Sinusoidal Parameter Estimation based on Quadratic Interpolation of FFT Magnitude Peaks", Proc. AES 117th Convention (2004).

Non-Patent Document 23: Bonada, J., "Wide-Band Harmonic Sinusoidal Modeling", Proc. DAFx-08, pp. 265-272 (2008).

Non-Patent Document 24: Ito, M. and Yano, M., "Sinusoidal Modeling for Nonstationary Voiced Speech based on a Local Vector Transform", J. Acoust. Soc. Am., Vol. 121, No. 3, pp. 1717-1727 (2007).

Non-Patent Document 25: Pavlovets, A. and Petrovsky, A., "Robust HNR-based Closed-loop Pitch and Harmonic Parameters Estimation", Proc. INTERSPEECH2011, pp. 1981-1984 (2011).

Non-Patent Document 26: Kameoka, H., Ono, N. and Sagayama, S., "Auxiliary Function Approach to Parameter Estimation of Constrained Sinusoidal Model for Monaural Speech Separation", Proc. ICASSP 2008, pp. 29-32 (2008).

Non-Patent Document 27: Kawahara, H., Masuda-Katsuse, I. and de Cheveigne, A., "Restructuring Speech Representations Using a Pitch Adaptive Time-frequency Smoothing and an Instantaneous Frequency Based on F0 Extraction: Possible Role of a Repetitive Structure in Sounds", Speech Communication, Vol. 27, pp. 187-207 (1999).

Non-Patent Document 28: Kawahara, H., Morise, M., Takahashi, T., Nishimura, R., Irino, T. and Banno, H., "Tandem-STRAIGHT: A Temporally Stable Power Spectral Representation for Periodic Signals and Applications to Interference-free Spectrum, F0, and Aperiodicity Estimation", Proc. of ICASSP 2008, pp. 3933-3936 (2008).

Non-Patent Document 29: Akagiri, H., Morise M., Irino, T., and Kawahara, H., "Evaluation and Optimization of F0-Adaptive Spectral Envelope Extraction Based on Spectral Smoothing with Peak Emphasis", IEICE, Journal Vol. J94-A, No. 8, pp. 557-567 (2011).

Non-Patent Document 30: Morise, M., Matsubara, T., Nakano, K., and Nishiura N., "A Rapid Spectrum Envelope Estimation Technique of Vowel for High-Quality Speech Synthesis", IEICE, Journal Vol. J94-D, No. 7, pp. 1079-1087 (2011).

Non-Patent Document 31: Morise, M.: PLATINUM, "A Method to Extract Excitation Signals for Voice Synthesis System", Acoust. Sci. & Tech., Vol. 33, No. 2, pp. 123-125 (2012).

Non-Patent Document 32: Bannno, H., Jinlin, L., Nakamura, S. Shikano, K., and Kawahara, H., "Efficient Representation of Short-Time Phase Based on Time-Domain Smoothed Group Delay", IEICE, Journal Vol. J84-D-II, No. 4, pp. 621-628 (2001).

Non-Patent Document 33: Bannno, H., Jinlin, L., Nakamura, S. Shikano, K., and Kawahara, H., "Speech Manipulation Method Using Phase Manipulation Based on Time-Domain Smoothed Group Delay", IEICE, Journal Vol. J83-D-II, No. 11, pp. 2276-2282 (2000).

Non-Patent Document 34: Zolfaghari, P., Watanabe, S., Nakamura, A. and Katagiri, S., "Bayesian Modelling of the Speech Spectrum Using Mixture of Gaussians", Proc. ICASSP 2004, pp. 553-556 (2004).

Non-Patent Document 35: Kameoka, H., Ono, N. and Sagayama, S., "Speech Spectrum Modeling for Joint Estimation of Spectral Envelope and Fundamental Frequency", IEEE Transactions on Audio, Speech, and Language Processing, Vol. 18, No. 6, pp. 1507-1516 (2010).

Non-Patent Document 36: Akamine, M. and Kagoshima, T., "Analytic Generation of Synthesis Units by Closed Loop Training for Totally Speaker Driven Text to Speech System (TOS Drive TTS)", Proc. ICSLP1998, pp. 1927-1930 (1998).

Non-Patent Document 37: Shiga, Y. and King, S., "Estimating the Spectral Envelope of Voiced Speech Using Multi-frame Analysis", Proc. EUROSPEECH2003, pp. 1737-1740 (2003).

Non-Patent Document 38: Toda, T. and Tokuda, K., "Statistical Approach to Vocal Tract Transfer Function Estimation Based on Factor Analyzed Trajectory HMM", Proc. ICASSP2008, pp. 3925-3928 (2008).

Non-Patent Document 39: Fujihara, H., Goto, M. and Okuno, H. G., "A Novel Framework for Recognizing Phonemes of Singing Voice in Polyphonic Music", Proc. WASPAA2009, pp. 17-20 (2009).

SUMMARY OF INVENTION

Technical Problem

Several conventional methods of estimating spectral envelopes and group delays assume that additional information such as pitch marks and phoneme transcriptions (phoneme labels) are available. Here, a pitch mark is time information indicating a driving point of a waveform (and time of analysis) for analysis synchronized with fundamental frequency. The time of excitation of a glottal sound source or the time at which amplitude is large in a fundamental period is used for a pitch mark. Such conventional methods require a large amount of information for analysis. In addition, improvements of applicability of estimated spectral envelopes and group delays are limited.

Accordingly, an object of the present invention is to provide an estimation system and an estimation method of spectral envelopes and group delays for sound analysis and synthesis, whereby spectral envelopes and group delays can be estimated from an audio signal with high accuracy and high temporal resolution for high-accuracy analysis and high-quality synthesis of voices (singing and speech).

Another object of the present invention is to provide a synthesis system and a synthesis method of an audio signal with higher synthesis performance than ever.

A further object of the present invention is to provide a computer-readable recording medium recorded with a program for estimating spectral envelopes and group delays for sound analysis and synthesis and a program for audio signal synthesis.

Solution to Problem

An estimation system of spectral envelopes and group delays for sound analysis and synthesis according to the present invention comprises at least one processor operable to function as a fundamental frequency estimation section, an amplitude spectrum acquisition section, a group delay extraction section, a spectral envelope integration section, and a group delay integration section. The fundamental frequency estimation section estimates F0s from an audio signal at all points of time or at all points of sampling. The amplitude spectrum acquisition section divides the audio signal into a plurality of frames, centering on each point of time or each point of sampling, by using a window having a window length changing or varying with F0 (fundamental frequency) at each point of time or each point of sampling, and performs Discrete Fourier Transform (DFT) analysis on the plurality of frames of the audio signal. Thus, the amplitude spectrum acquisition section acquires amplitude spectra at the respective frames. The group delay extraction section extracts group delays as phase frequency differentials at the respective frames by performing a group delay extraction algorithm accompanied by DFT analysis on the plurality of frames of the audio signal. The spectral envelope integration section obtains overlapped spectra at a predetermined time interval by overlapping the amplitude spectra corresponding to the frames included in a certain period which is determined based on a fundamental period of F0. Then, the spectral envelope integration section averages the overlapped spectra to sequentially obtain a spectral envelope for sound synthesis. The group delay integration section selects a group delay corresponding to a maximum envelope for each frequency component of the spectral envelope from the group delays at a predetermined time interval, and integrates the thus selected group delays to sequentially obtain a group delay for sound synthesis. According to the present invention, the overlapped spectra are obtained from amplitude spectra of the respective frames. Then, a spectral envelope for sound synthesis is sequentially obtained from the overlapped spectra thus obtained. From a plurality of group delays, a group delay is selected, corresponding to the maximum envelope of each frequency component of the spectral envelope. Group delays thus selected are integrated to sequentially obtain a group delay for sound synthesis. The spectral envelope for sound synthesis thus estimated has high accuracy. The group delay for sound synthesis thus estimated has higher accuracy than ever.

In the fundamental frequency estimation section, voiced segments and unvoiced segments are identified in addition to the estimation of F0s, and the unvoiced segments are interpolated with F0 values of the voiced segments or predetermined values are allocated to the unvoiced segments as F0. With this, spectral envelopes and group delays can be estimated in unvoiced segments in the same manner as in the voiced segments.

In the spectral envelope integration section, the spectral envelope for sound synthesis may be obtained by arbitrary methods of averaging the overlapped spectra. For example, a spectral envelope for sound synthesis may be obtained by calculating a mean value of the maximum envelope and the minimum envelope of the overlapped spectra. Alternatively, a median value of the maximum envelope and the minimum envelope of the overlapped spectra may be used as a mean value to obtain a spectral envelope for sound synthesis. In this manner, a more appropriate spectral envelope can be obtained even if the overlapped spectra greatly fluctuate.

Preferably, the maximum envelope is transformed to fill in valleys of the minimum envelope and a transformed minimum envelope thus obtained is used as the minimum envelope in calculating the mean value. The minimum enveloper thus obtained may increase the naturalness of hearing impression of synthesized sounds.

Preferably in the spectral envelope integration section, the spectral envelope for sound synthesis is obtained by replacing amplitude values of the spectral envelope of frequency bins under F0 with a value of the spectral envelope at F0. This is because the estimated spectral envelope of frequency bins under F0 is unreliable. In this manner, the estimated spectral envelope of frequency bins under F0 becomes reliable, thereby increasing the naturalness of hearing impression of the synthesized sounds.

A two-dimensional low-pass filter may be used to filter the replaced spectral envelope. Filtering can remove noise from the replaced spectral envelope, thereby furthermore increasing the naturalness of hearing impression of the synthesized sounds.

In the group delay integration section, it is preferred to store by frequency the group delays in the frames corresponding to the maximum envelopes for respective frequency components of the overlapped spectra, to compensate a time-shift of analysis of the stored group delays, and to normalize the stored group delays for use in sound synthesis. This is because the group delays spread along the time axis or in a temporal direction (at a time interval) according to a fundamental period corresponding to F0. Normalizing the group delays along the time axis may eliminate effects of F0 and obtain group delays transformable according to F0 at the time of resynthesizing.

Also in the group delay integration section, it is preferred to obtain the group delay for sound synthesis by replacing values of group delay of frequency bins under F0 with a value of the group delay at F0. This is because the estimated group delays of frequency bins under F0 are unreliable. In this manner, the estimated group delays of frequency bins under F0 become reliable, thereby increasing the naturalness of hearing impression of the synthesized sounds.

Further, in the group delay integration section, it is preferred to smooth the replaced group delays for use in sound synthesis. It is convenient for sound analysis and synthesis if the values of group delays change continuously.

Preferably, in smoothing the replaced group delays for use in sound synthesis, the replaced group delays are converted with sin function and cos function to remove discontinuity due to the fundamental period; the converted group delays are subsequently filtered with a two-dimensional low-pass filter; and then the filtered group delays are converted to an original state with $\tan^{-1}$ function for use in sound synthesis. It is convenient for two-dimensional low-pass filtering if the group delays are converted with sin function and cos function.

An audio signal synthesis system according to the present invention comprises at least one processor operable to function as a reading section, a conversion section, a unit waveform generation section, and a synthesis section. The reading section reads out, in a fundamental period for sound synthesis, the spectral envelopes and group delays for sound synthesis from a data file of the spectral envelopes and group delays for sound synthesis that have been estimated by the estimation system of spectral envelopes and group delays for sound analysis and synthesis according to the present invention. Here, the fundamental period for sound synthesis is a reciprocal of the fundamental frequency for sound synthesis. The spectral envelopes and group delays, which have been estimated by the estimation system, have been stored at a predetermined interval in the data file. The conversion section converts the read-out group delays into phase spectra. The unit waveform generation section generates unit waveforms based on the read-out spectral envelopes and the phase spectra. The synthesis section outputs a synthesized audio signal obtained by performing overlap-add calculation on the generated unit waveforms in the fundamental period for sound synthesis. The sound synthesis system according to the present invention can generally reproduce and synthesize the group delays and attain high-quality naturalness of the synthesized sounds.

The audio signal synthesis system according to the present invention may include a discontinuity suppression section which suppresses an occurrence of discontinuity along the time axis in a low frequency range of the read-out group delays before the conversion section converts the read-out group delays. Providing the discontinuity suppression section may furthermore increase the naturalness of synthesis quality.

The discontinuity suppression section is preferably configured to smooth group delays in the low frequency range after adding an optimal offset to the group delay for each voiced segment and re-normalizing the group delay. Smoothing in this manner may eliminate unstableness of the group delays in a low frequency range. It is preferred in smoothing the group delays to convert the read-out group delays with sin function and cos functions, to subsequently filter the converted group delays with a two-dimensional low-pass filter, and then to convert the filtered group delays to an original state with $\tan^{-1}$ function for use in sound synthesis. Thus, two-dimensional low-pass filtering is enabled, thereby facilitating the smoothing.

Further, the audio signal synthesis system according to the present invention preferably includes a compensation section which multiplies the group delays by the fundamental period for sound synthesis as a multiplier coefficient after the conversion section converts the group delays or before the discontinuity suppression section suppresses the discontinuity. With this, it is possible to normalize the group delays which spread along the time axis (at a time interval) according to the fundamental period corresponding to F0, thereby obtaining more accurate phase spectra.

The synthesis section is preferably configured to convert an analysis window into a synthesis window and perform overlap-add calculation in the fundamental period on compensated unit waveforms obtained by windowing the unit waveforms by the synthesis window. The unit waveforms compensated with such synthesis window may increase the naturalness of hearing impression of the synthesized sounds.

An estimation method of spectral envelopes and group delays according to the present invention is implemented on at least one processor to execute a fundamental frequency estimation step, an amplitude spectrum acquisition step, a group delay extraction step, a spectral envelope integration step, and a group delay integration step. In the fundamental frequency estimation step, F0s are estimated from an audio signal at all points of time or at all points of sampling. In the amplitude spectrum acquisition step, the audio signal is divided into a plurality of frames, centering on each point of time or each point of sampling, by using a window having a window length changing or varying with F0 at each point of time or each point of sampling; Discrete Fourier Transform (DFT) analysis is performed on the plurality of frames of the audio signal; and amplitude spectra are thus acquired at the respective frames. In the group delay extraction step, group delays are extracted as phase frequency differentials at the respective frames by performing a group delay extraction algorithm accompanied by DFT analysis on the plurality of frames of the audio signal. In the spectral envelope integration step, overlapped spectra are obtained at a predetermined time interval by overlapping the amplitude spectra corresponding to the frames included in a certain period which is determined based on a fundamental period of F0; and the overlapped spectra are averaged to sequentially obtain a spectral envelope for sound synthesis. In the group delay integration step, a group delay is selected, corresponding to the maximum envelope for each frequency component of the spectral envelope from the group delays at a predetermined time interval, and the thus selected group delays are integrated to sequentially obtain a group delay for sound synthesis.

A program for estimating spectral envelopes and group delays for sound analysis and synthesis adapted to implement the above-mentioned method on a computer is recorded in a non-transitory computer-readable recording medium.

An audio signal synthesis method according to the present invention is implemented on at least one processor to execute a reading step, a conversion step, a unit waveform generation step, and a synthesis step. In the reading step, the spectral envelopes and group delays for sound synthesis are read out, in a fundamental period for sound synthesis, from a data file of the spectral envelopes and group delays for sound synthesis that have been estimated by the estimation method of spectral envelopes and group delays according to the present invention. Here, the fundamental period for sound synthesis is a reciprocal of the fundamental frequency for sound synthesis, and the spectral envelopes and group delays that have been estimated by the estimation method according to the present invention have been stored at a predetermined interval in the data file. In the conversion step, the read-out group delays are converted into phase spectra. In the unit waveform generation step, unit waveforms are generated based on the read-out spectral envelopes and the phase spectra. In the synthesis step, a synthesized audio signal, which has been obtained by performing overlap-add calculation on the generated unit waveforms in the fundamental period for sound synthesis, is output.

A program for audio signal synthesis adapted to implement the above-mentioned audio signal synthesis method on a computer is recorded in a non-transitory computer-readable recording medium.

BRIEF DESCRIPTION OF DRAWINGS

FIGS. 2A, 3B, and 2C respectively show a waveform of a singing voice signal, a spectral envelope thereof, and (normalized) group delay in a relation manner.

FIG. 12 illustrates temporal contours of a spectrum obtained by the multi-frame integration analysis and a spectrum filtered with a two-dimensional low-pass filter.

FIGS. 13A and 13B respectively illustrate a maximum envelope and a group delay corresponding to the maximum envelope.

FIGS. 17A to 17D illustrate various states of group delay in normalization steps.

DESCRIPTION OF EMBODIMENTS

Figure 1:
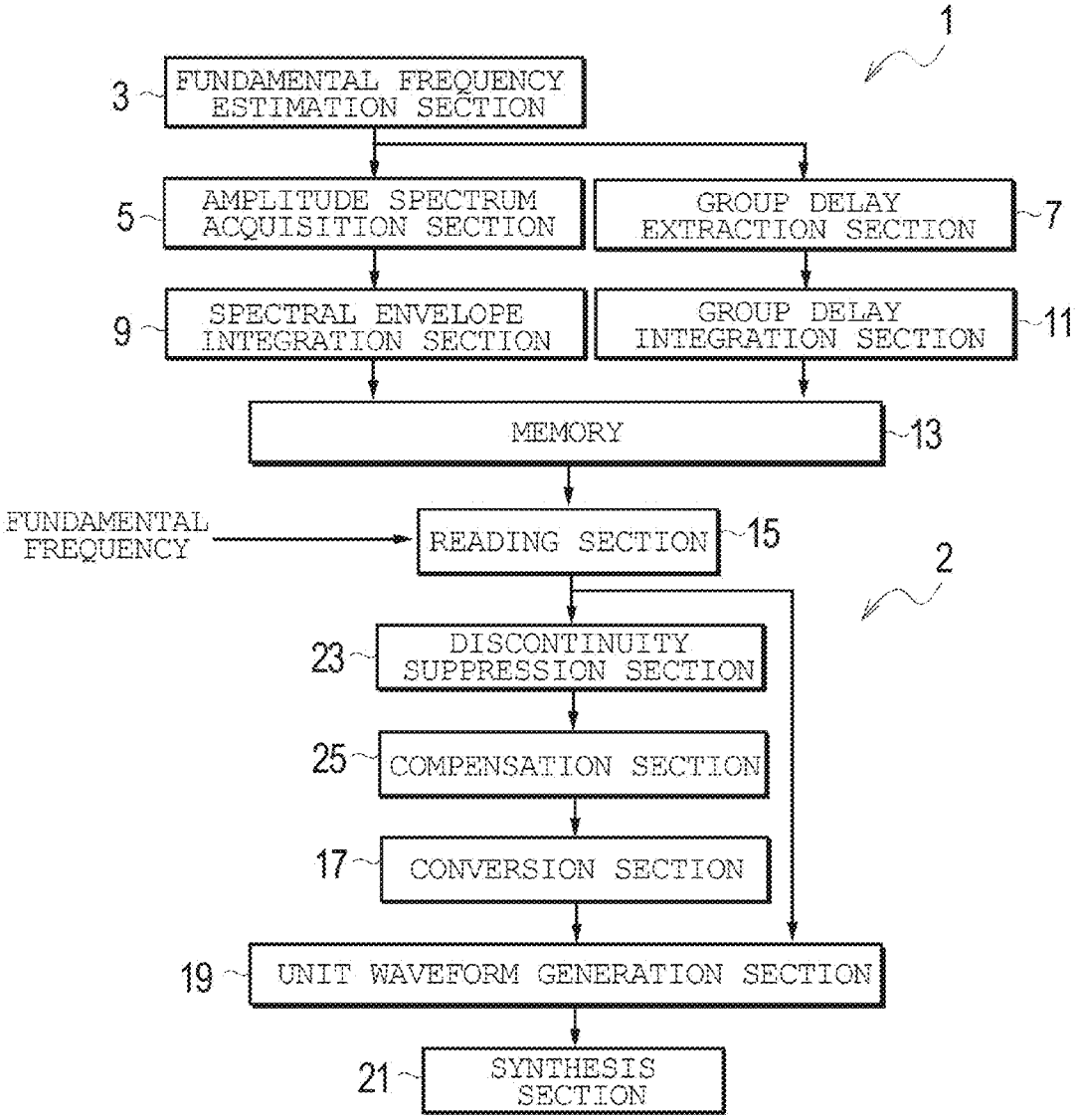
FIG. 1 is a block diagram showing a basic configuration of an embodiment of an estimation system of spectral envelopes and group delays for sound analysis and synthesis and an audio signal synthesis system according to the present invention.

Now, embodiments of the present invention will be described below in detail. FIG. 1 is a block diagram showing a basic configuration of an embodiment of an estimation system of spectral envelopes and group delays for sound analysis and synthesis and an example audio signal synthesis system according to the present invention. In one embodiment of the present invention, the estimation system 1 of spectral envelopes and group delays comprises a memory 13 and at least one processor operable to function as a fundamental frequency estimation section 3, an amplitude spectrum acquisition section 5, a group delay extraction section 7, a spectral envelope integration section 9, and a group delay integration section 11. A computer program installed in the processor causes the processor to operate as the above-mentioned sections. The audio signal synthesis system 2 comprises at least one processor operable to function as a reading section 15, a conversion section 17, a unit waveform generation section 19, a synthesis section 21, a discontinuity suppression section 23, and a compensation section 25. A computer program installed in the processor causes the processor to operate as the above-mentioned sections.

Figure 2A:
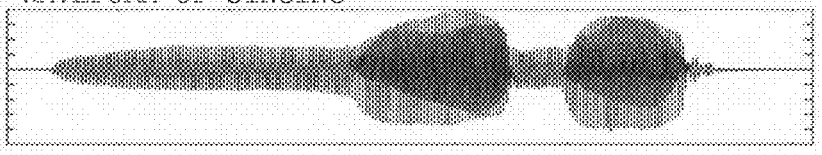
Figure 2B:
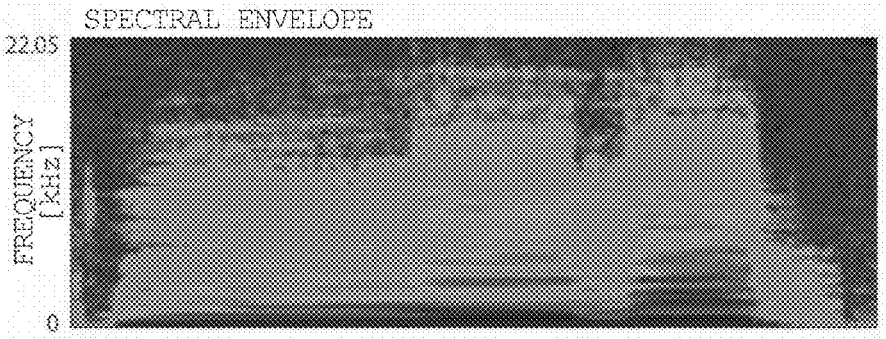
Figure 2C:
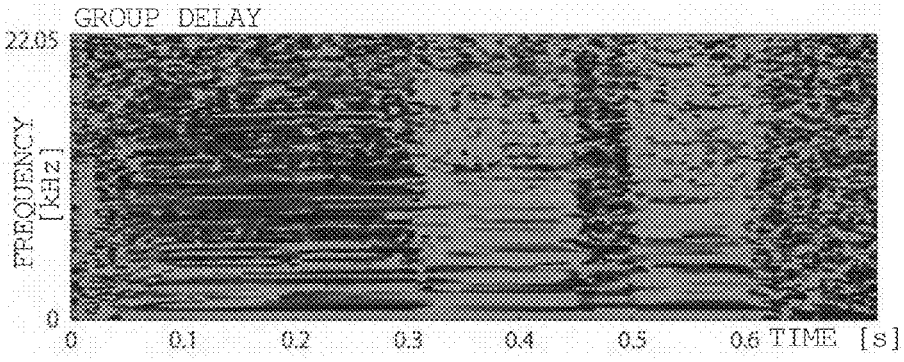
Figure 3:
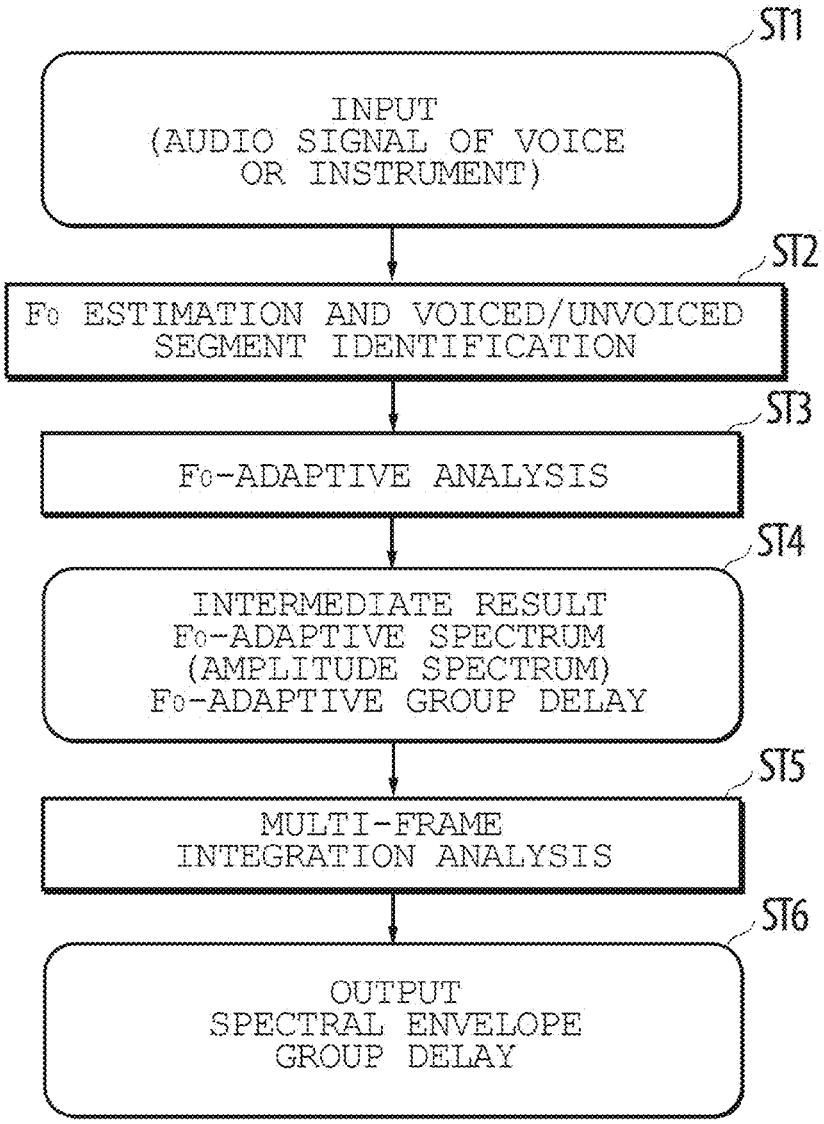
FIG. 3 is a flowchart showing a basic algorithm of a computer program used to implement the present invention on a computer.
Figure 4:
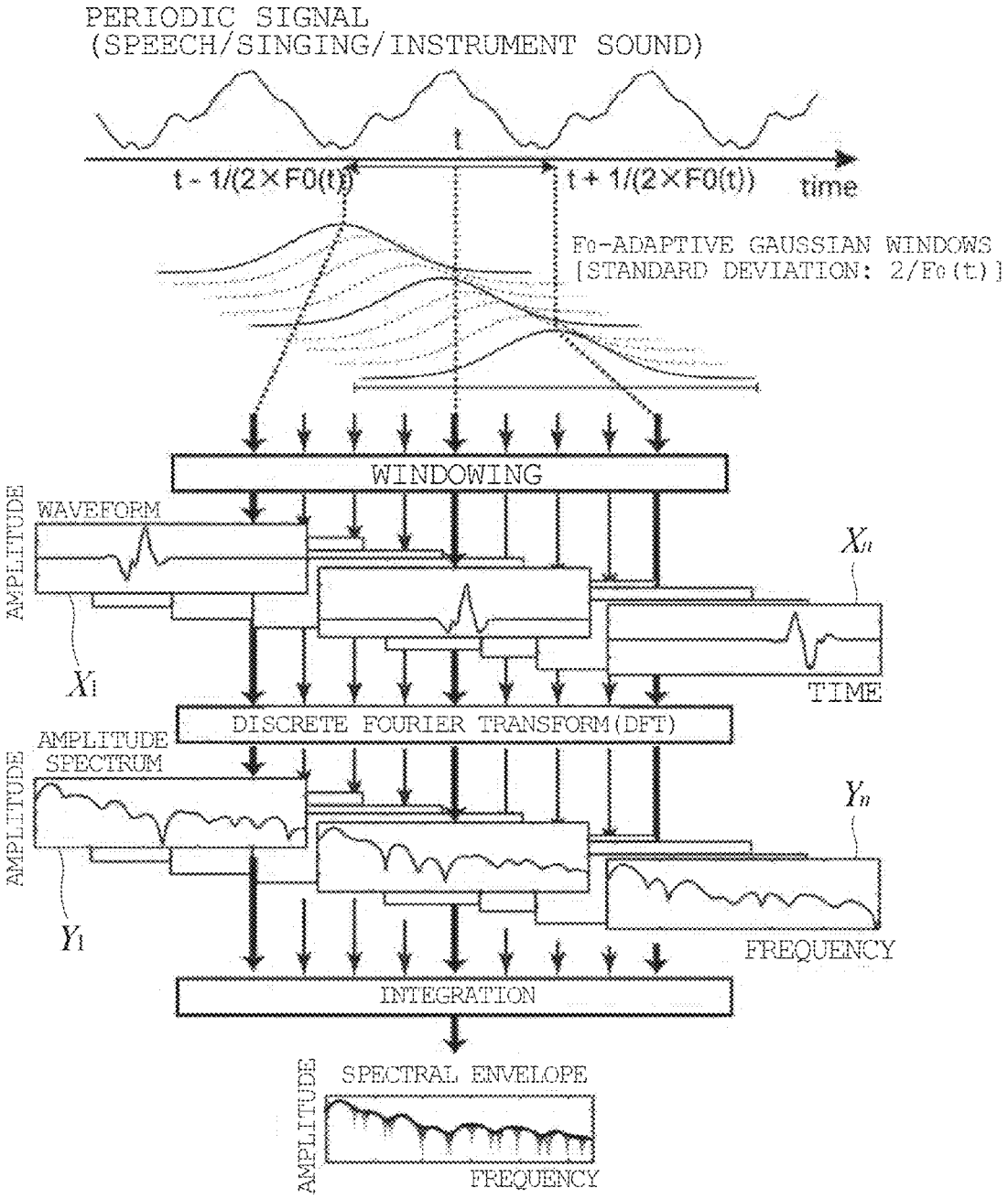
FIG. 4 schematically illustrates steps of estimating spectral envelopes for sound synthesis.
Figure 5:
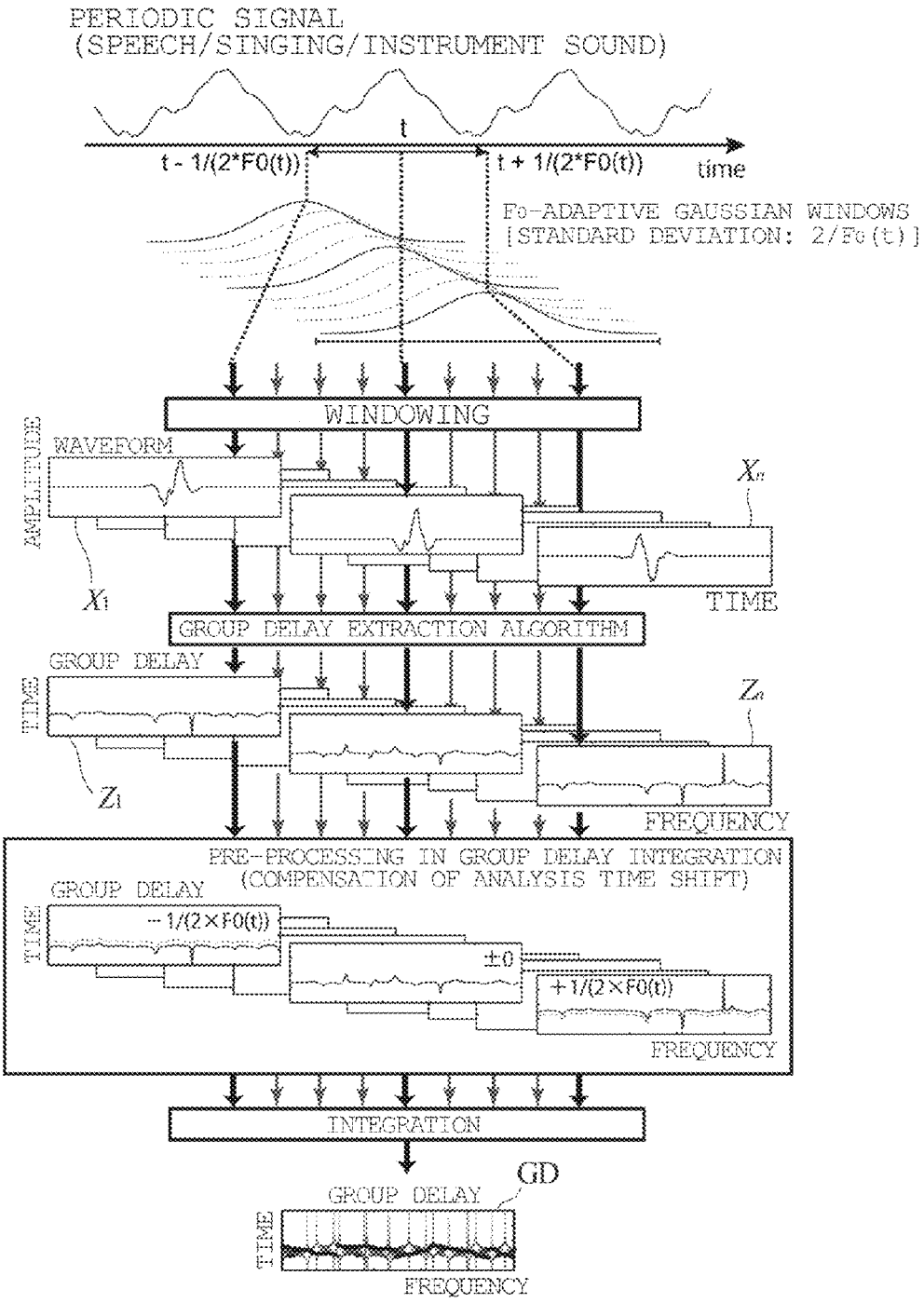
FIG. 5 schematically illustrates steps of estimating group delays for sound synthesis.

The estimation system 1 of spectral envelopes and group delays estimates a spectral envelope for sound synthesis as shown in FIG. 2B and a group delay for synthesis as phase information as shown in FIG. 2C from an audio signal (a waveform of singing) as shown in FIG. 2A. In FIGS. 2B and 2C, a lateral axis is time and a longitudinal axis is frequency, and the amplitude of a spectral envelope and the relative magnitude of a group delay at a certain time and frequency are indicated with different colors and gray scales. FIG. 3 is a flowchart showing a basic algorithm of a computer program used to implement the present invention on a computer. FIG. 4 schematically illustrates steps of estimating spectral envelopes for sound synthesis. FIG. 5 schematically illustrates steps of estimating group delays for sound synthesis.

[Estimation of Spectral Envelopes and Group Delays]

Figure 6:
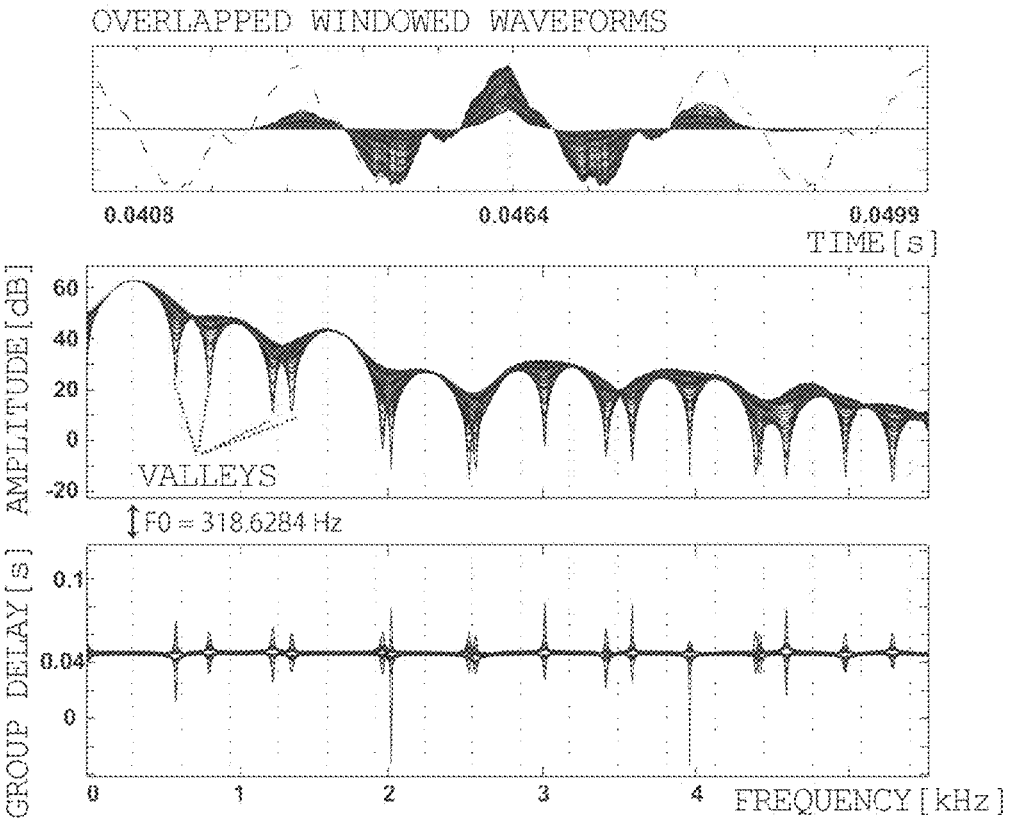
FIG. 6 illustrates overlapped frames windowed by Gaussian windows having a F0-dependent time constant (in the top), their corresponding spectra (in the middle), and their corresponding group delays (in the bottom).
Figure 7:
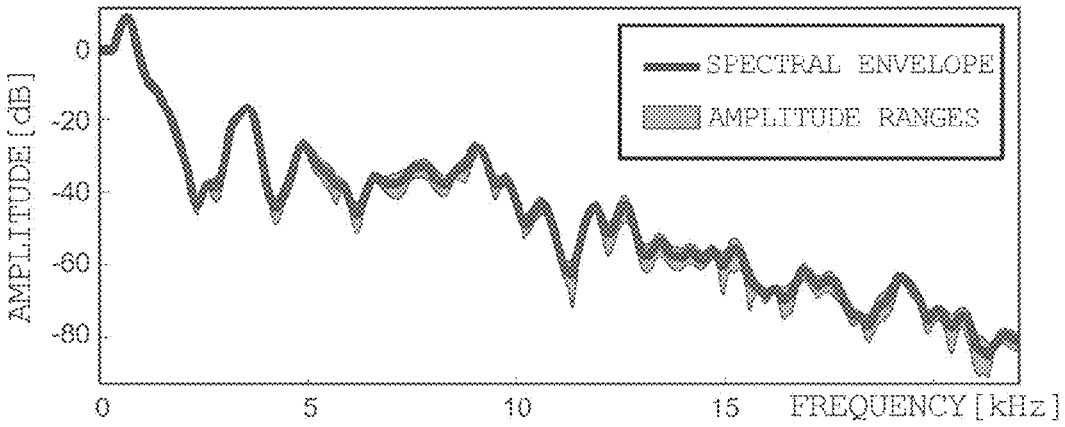
FIG. 7 illustrates an estimated spectral envelope obtained by F0-adaptive multi-frame integration analysis and an amplitude range thereof.

In this embodiment of the present invention, first, a method of obtaining spectral envelopes and group delays for sound synthesis will briefly be described below. FIG. 6 illustrates spectral envelopes and group delays obtained from waveforms in a plurality of frames and their corresponding short-term Fourier Transform (STFT) results. As shown in FIG. 6, there is a valley in one frame and the valley is filled in another frame. This suggests that stable spectral envelopes can be obtained by integrating these STFT results. From the fact that the peak of group delay (far from the time of analysis) corresponds to the valley of the spectrum, it can be known that a smooth envelope cannot be obtained merely by using a single window. Then, in this embodiment, the audio signal is divided into a plurality of frames, centering on each point of time or each point of sampling, using windows having a window length changing according to F0s at all points of time or all points of sampling. Also in this embodiment, it is assumed that an estimated spectral envelope for sound synthesis should exist in a range between the maximum and minimum envelopes of overlapped spectra as described later. First, the maximum value (the maximum envelope) and the minimum value (the minimum envelope) are calculated. Here, it is noted that a smooth envelope along the time axis cannot be obtained merely by manipulating the maximum and minimum envelopes since the envelope depicts a step-like contour according to F0. Therefore, the envelope is smoothed. Finally, the spectral envelope for sound synthesis is obtained as a mean of the maximum and minimum envelopes. At the same time, the range between the maximum and minimum envelopes is stored as amplitude ranges for spectral envelopes (see FIG. 7). A value corresponding to the maximum envelope is used as an estimated group delay in order to represent the most resonating time.

In this embodiment of the estimation system 1 of spectral envelopes and group delays according to the present invention (see FIG. 1) that executes the method of the present invention, the fundamental frequency estimation section 3 receives an audio signal (singing and speech without accompaniment and high noise) as an input (at step ST1 of FIG. 3) and estimates F0s at all points of time or all points of sampling based on the input audio signal. In this embodiment, estimation is performed in units of 1/44100 seconds. At the same time with the estimation, voiced segments and unvoiced segments are identified (in step ST2 of FIG. 3). In the identification, a threshold of periodicity, for example, is specified and a segment is identified as a voiced segment and distinguished from an unvoiced segment if the segment has a higher periodicity than the threshold. An appropriate constant value of F0 may be allocated to an unvoiced segment. Alternatively, F0s are allocated to unvoiced segments by linear interpolation such that neighborhood voiced segments are connected. Thus, the fundamental frequencies are not disconnected. A method described in Non-Patent Document 27 or the like, for example, may be used for pitch estimation. It is preferred to estimate F0 with as high accuracy as possible.

The amplitude spectrum acquisition section 5 performs F0-adaptice analysis as shown in step ST3 of FIG. 3 and acquires an F0-adaptive spectrum (an amplitude spectrum) as shown in step ST4 of FIG. 3. The amplitude spectrum acquisition section 5 divides the audio signal into a plurality of frames, centering on each point of time or each point of sampling, using windows having a window length changing according to F0s at all points of time or all points of sampling.

Specifically, in this embodiment, a Gaussian window $\omega(\tau)$ of formula (1) with the window length changing according to F0 is used for windowing as shown in FIG. 4. Thus, frames X1 to Xn are obtained by dividing the waveform of the audio signal in units of time. Here, $\sigma(t)$ is the standard deviation determined by the fundamental frequency, F0(t) at time t of analysis. The Gaussian window is normalized by the root means square (RMS) value calculated with N defined as the FFT length.

⟨Formula (1)⟩

$$\omega(\tau) = \frac{\hat{\omega}(\tau)}{\sqrt{(1/N)\sum_{\tau=0}^{N-1} \hat{\omega}(\tau)^2}} \quad (1)$$

$$\hat{\omega}(\tau) = \exp\left(-\frac{\tau^2}{2\sigma(t)^2}\right) \quad (2)$$

$$\sigma(t) = \frac{1}{F_0(t)} \times \frac{1}{3} \quad (3)$$

The Gaussian window of σ(t)=⅓×F0(t)) means that the analysis window length corresponds to two fundamental periods, (2×3σ(t)=2/F0(t)). This window length is also used in PSOLA analysis and is known to give a good approximation of the local spectral envelope (refer to Non-Patent Document 1).

Figure 8:
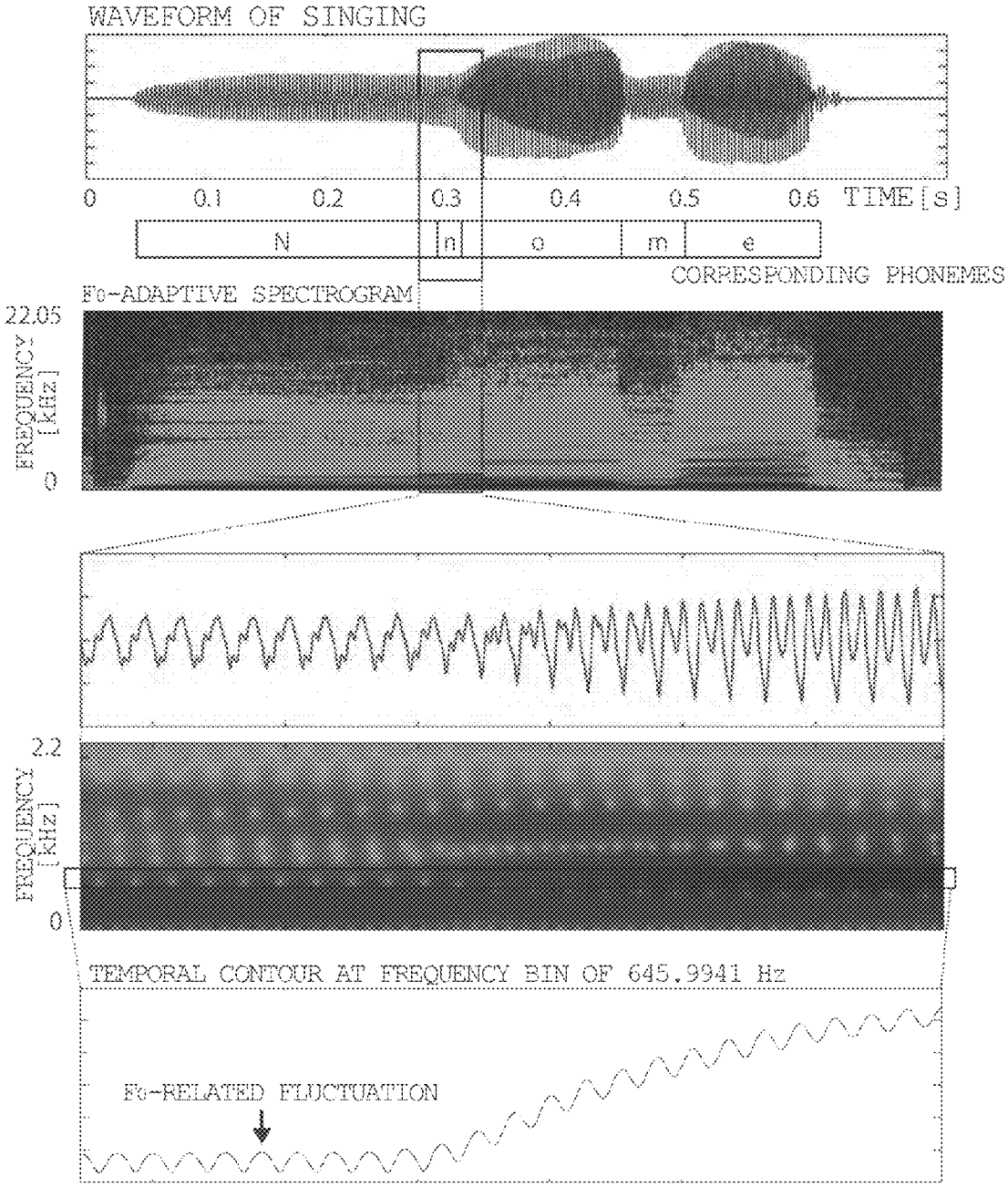
FIG. 8 illustrates a waveform of singing voice and its F0-adaptive spectrum (in the top), its close-up view (in the middle), and a temporal contour at frequency of 645.9961 Hz (in the bottom).

Next, the amplitude spectrum acquisition section 5 performs Discrete Fourier Transform (DFT) including Fast Fourier Transform (FFT) analysis on the divided frames X1 to Xn of the audio signal. Thus, the amplitude spectra Y1 to Yn of the respective frames X1 to Xn are obtained. FIG. 8 illustrates F0-adaptive analysis results. The amplitude spectra thus obtained include F0-related fluctuations along the time axis. The peaks appear, being slightly shifted along the time axis according to the frequency band. Herein, this is called as F0-adaptive spectrum. FIG. 8 illustrates a waveform of singing voice (in the top row), a F0-adaptive spectrum thereof (in the second row), and close-up views of the upper figure (in the third to fifth rows), showing the temporal contour at frequency of 645.9961 Hz.

The amplitude spectrum acquisition section 5 performs F0-adaptive analysis as shown in step ST3 of FIG. 3, and acquires F0-adaptive spectra (amplitude spectra) as shown in step ST4 of FIG. 3. The amplitude spectrum acquisition section 5 divides the audio signal into a plurality of frames, centering on each point of time or each point of sampling, using windows having a window length changing according to F0s at all points of time or all points of sampling. In this embodiment, windowing is performed using a Gaussian window with its window length changing according to F0 as shown in FIGS. 4 and 5. Thus, frames X1 to Xn are obtained by dividing the waveform of the audio signal in units of time. Of course, F0-adaptive analysis may be performed both in the amplitude spectrum acquisition section 5 and the group delay extraction section 7. The group delay extraction section 7 executes a group delay extraction algorithm accompanied by Discrete Fourier Transform (DFT) analysis on the frames X1 to Xn of the audio signal. Then, the group delay extraction section 7 extracts group delays Z1 to Zn as phase frequency differentials in the respective framesXl to Xn. An example of group delay extraction algorithm is described in detail in Non-Patent Documents 32 and 33.

Figure 9:
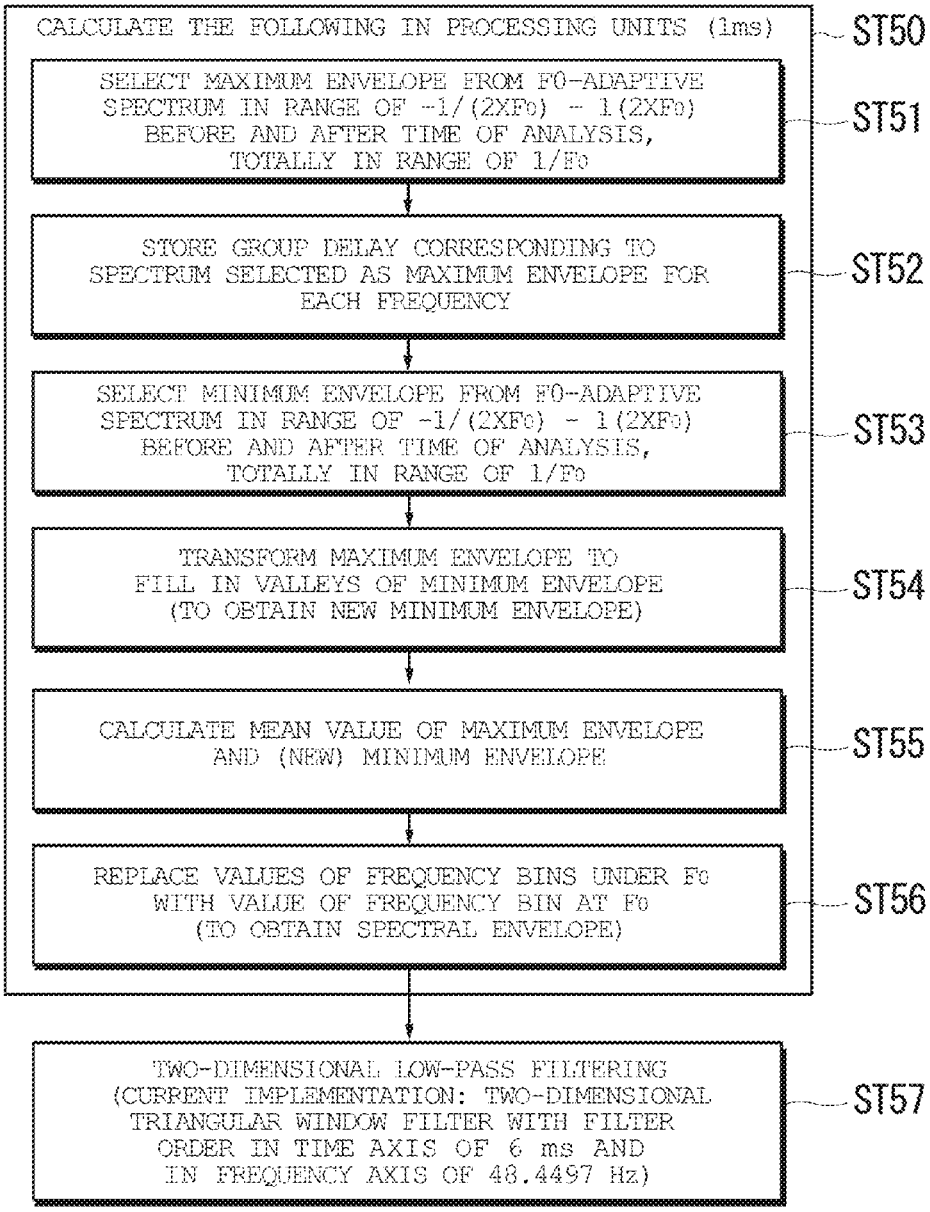
FIG. 9 shows steps ST50 through ST57 of obtaining a spectral envelope SE at step ST5, multi-frame integration analysis of FIG. 3.
Figure 10:
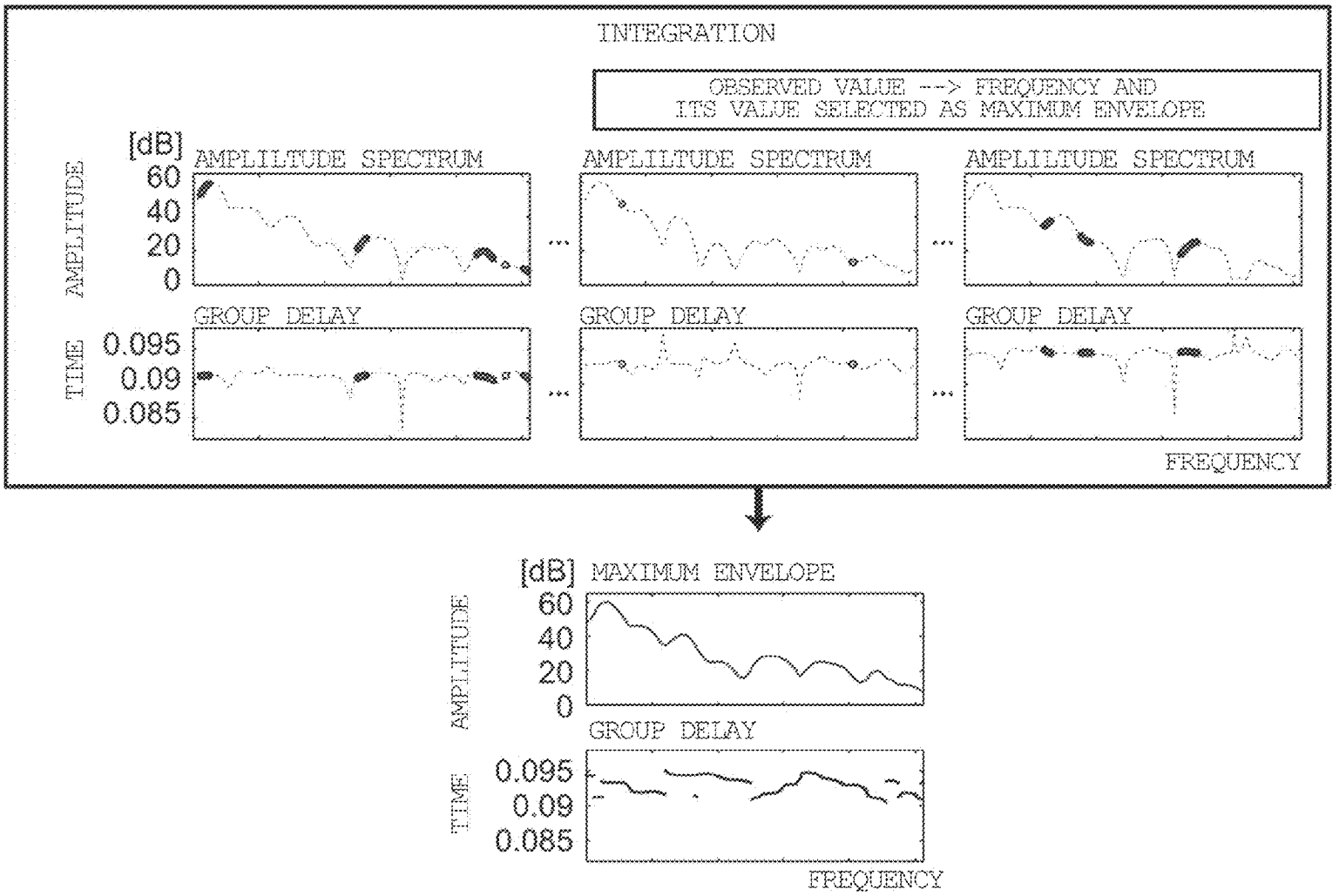
FIG. 10 illustrates an integration process.

The spectral envelope integration section 9 overlaps a plurality of amplitude spectra corresponding to the plurality of frames included in a certain period, which is determined based on the fundamental period (1/F0) of F0, at a predetermined interval, namely, in a discrete time of spectral envelope (at an interval of 1 ms in this embodiment). Thus, overlapped spectra are obtained. Then, a spectral envelope SE for sound synthesis is sequentially obtained by averaging the overlapped spectra. FIG. 9 shows steps ST50 through ST57 of obtaining a spectral envelope SE at step ST5, multi-frame integration analysis of FIG. 3. Steps ST51 through ST57 included in step ST50 are performed every 1 ms. Step ST52 is performed to obtain a group delay GD for sound synthesis as described later. At step ST51, the maximum envelope is selected from the overlapped spectra obtained by overlapping amplitude spectra (F0-adaptive spectra) for the frames included in the range before and after the time t of analysis, −1/(2×F0) to 1/(2×F0). In FIG. 10, portions where the amplitude spectrum becomes the highest are indicated in dark color at each frequency of the amplitude spectra for the frames included in the range of −1/(2×F0) to 1/(2×F0) before and after the time t of analysis in order to obtain the maximum envelope from the overlapped spectra obtained by overlapping the amplitude spectra for the frames in the range of −1/(2×F0) to 1/(2×F0). Here, the maximum envelope is obtained from connecting the highest amplitude portions of each frequency. At step ST52, group delays corresponding to the frames, in which the amplitude spectrum is selected as the maximum envelope at step ST51, are stored by frequency. Namely, as shown in FIG. 10, based on the group delay value corresponding to an amplitude spectrum from which the maximum amplitude has been obtained, the group delay value (time) corresponding to a frequency at which the maximum amplitude has been obtained is stored as a group delay corresponding to that frequency. Next, at step ST53, the minimum envelope is selected from the overlapped spectra obtained by overlapping amplitude spectra (F0-adaptive spectra) for the frames in the range of −1/(2×F0) to 1/(2×F0) before and after the time t of analysis. Namely, obtaining the minimum envelope from the overlapped spectra for the frames in the range of −1/(2×F0) to 1/(2×F0) means that the minimum envelope is obtained by connecting the minimum amplitude portions at the respective frequencies of the amplitude spectra for the frames in the range of −1/(2×F0) to 1/(2×F0) before and after the time t of analysis.

It is arbitrary to employ what method by which "a spectral envelope for sound synthesis" is obtained by averaging the overlapped spectra. In this embodiment, a spectral envelope for sound synthesis is obtained by calculating a mean value of the maximum envelope and the minimum envelope (at step ST55). A median value of the maximum envelope and the minimum envelope may be used as a mean value in obtaining a spectral envelope for sound synthesis. In these manners, a more appropriate spectral envelope can be obtained even if the overlapped spectra greatly fluctuate.

In this embodiment, the maximum envelope is transformed to fill in the valleys of the minimum envelope at step ST54. Such transformed envelope is used as the minimum envelope. Such transformed minimum enveloped can increase the naturalness of hearing impression of synthesized sound.

In the spectral envelope integration section 9, at step ST56, the amplitude values of the spectral envelope of frequency bins under F0 are replaced with the amplitude value of a spectral envelope of frequency bin at F0 for use in the sound synthesis. This is because the spectral envelope of frequency bins under F0 is unreliable. With such replacement, the spectral envelope of frequency bins under F0 becomes reliable, thereby increasing the naturalness of hearing impression of the synthesized sound.

As described above, step ST50 (steps ST51 through ST56) is performed every predetermined time (1 ms), and a spectral envelope is estimated in each unit time (1 ms). In this embodiment, at step ST57, the replaced spectral envelope is filtered with a two-dimensional low-pass filter. Filtering can remove noise from the replaced spectral envelope, thereby furthermore increasing the naturalness of hearing impression of the synthesized sound.

Figure 11A:
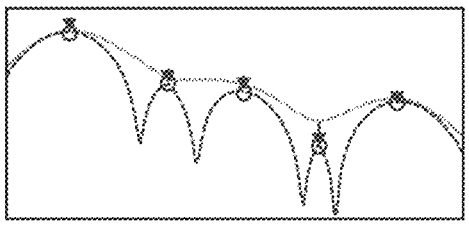
FIGS. 11A to 11C schematically illustrate estimated spectral envelopes as a mean value of the maxima and minimum envelopes.
Figure 11B:
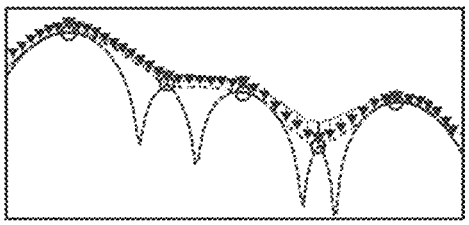
Figure 11C:
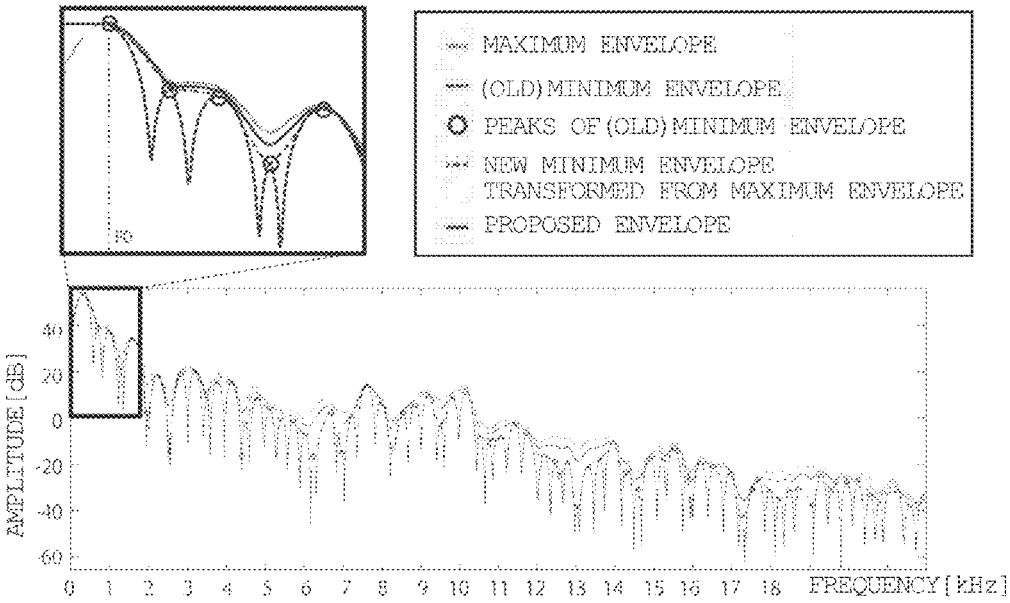

In this embodiment, the spectral envelope is defined as a mean value of the maximum value (the maximum envelope) and the minimum value (the minimum envelope) of the spectra in the range of integration (at step ST55). The maximum enveloped is not simply used as a spectral envelope. This is because such possibility should be considered as there is some sidelobe effect of the analysis window. Here, a number of valleys due to F0 remain in the minimum envelope, and such minimum envelope cannot readily be used as a spectral envelope. Then, in this embodiment, the maximum envelope is transformed to overlap the minimum envelope, thereby eliminating the valleys of the minimum envelope while maintaining the contour of the minimum envelope (at step ST54). FIG. 11 shows an example of the transformation and the flow of the calculation therefor. Specifically, as shown in FIG. 11A, peaks of the minimum envelope as indicated with a circle symbol (○) are calculated, and then an amplitude ratio of the maximum envelope and the minimum envelope at its frequency is calculated (as indicated with ↓). Next, as shown in FIG. 11B, the conversion ratio for the entire band is obtained by linearly interpolating the conversion ratio along the frequency axis (as indicated with ↓). A new minimum envelope is obtained by multiplying the maximum enveloper by the conversion ratio and then transforming the maximum envelope such that the new minimum envelope may be higher than the old minimum envelope. As shown in FIG. 11C, since estimated components under F0 are unreliable in many cases, the amplitude values of the envelope of frequency bins under F0 are replaced with the amplitude value at F0. The replacement is equivalent to smoothing with a window having a length of F0 (at step ST56). An envelope obtained by manipulating the maximum and minimum envelopes has a step-like contour, namely, step-like discontinuity along the time axis. Such discontinuity is removed with a two-dimensional low-pass filter along the time-frequency axes (at step ST57), thereby obtaining a smoothed spectral envelope along the time axis (see FIG. 12).

Figure 14A:
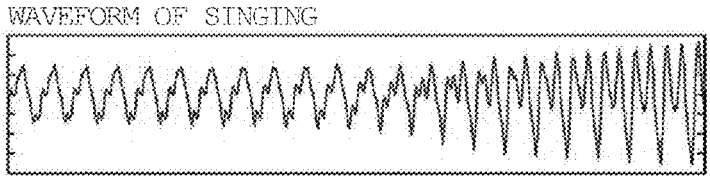
FIGS. 14A and 14B respectively illustrate a waveform of singing voice and its F0-adaptive spectrum and group delay corresponding to the maximum envelope.
Figure 14B:
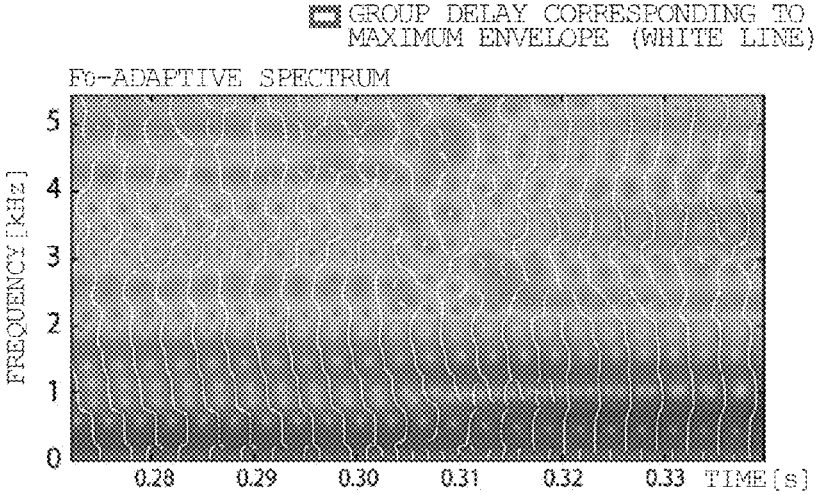

The group delay integration section 11 as shown in FIG. 1 selects from a plurality of group delays a group delay corresponding to the maximum envelope for each frequency component of the spectral envelope SE at a predetermined interval. Then, the group delay integration section 11 integrates the selected group delays to sequentially obtain a group delay GD for sound synthesis. Namely, a spectral envelope for sound synthesis is sequentially obtained from the overlapped spectra which have been obtained from amplitude spectra obtained for the respective frames. Then, the group delay integration section 11 selects from a plurality of group delays a group delay corresponding to the maximum envelope for each frequency component of the spectral envelope. And, the group delay integration section 11 integrates the selected group delays to sequentially obtain a group delay for sound synthesis. Here, a group delay for sound synthesis is defined as a value of group delay (see FIG. 13B) corresponding to the maximum envelope (see FIG. 13A) to represent the most resonating time in the rage of integration. In connection with the waveform of singing as shown in FIG. 14A, the thus obtained group delay GD is associated with the time of estimation and is overlapped on the F0-adaptive spectrum (amplitude spectrum) as shown in FIG. 14B. As known from FIG. 14B, the group delay corresponding to the maximum envelope almost corresponds to the peak time of the F0-adaptive spectrum.

Since the thus obtained group delay spreads along the time axis, according to the fundamental period corresponding to F0, the group delay is normalized along the time axis. The group delay corresponding to the maximum envelope at frequency f is expressed in formula (2).

$$\hat{g}(f,t) \qquad \text{<Formula (2)>}$$

The value of frequency bin corresponding to n×F0(t) is expressed in formula (3).

$$\hat{g}(f_{n\times F_0(t)},t) \qquad \text{<Formula (3)>}$$

The fundamental period (1/F0(t)) and the value of frequency bin of formula (3) are used to normalize the group delay. The normalized group delay g(f,t) is expressed in formula (4).

⟨Formula (4)⟩

$$g(f,t) = \mathrm{mod}(\hat{g}(f,t) - \hat{g}(f_{n\times F_0(t)},t), 1/F_0(t)) \div \frac{1}{F_0(t)} \tag{4}$$

Here, mod(x,y) denotes the remainder of the division of x by y.

An offset due to different times of analysis is eliminated as shown in Formula (5).

$$\hat{g}(f,t)-\hat{g}(f_{n\times F_0(t)},t) \qquad \text{<Formula (5)>}$$

Here, n=1 or n=1.5 where analysis may be unreliable in the proximity of n=1; in such case, more reliable result may be obtained based on the value between these harmonics.

As described above, the group delay g(f,t) is normalized in the range of (0,1). However, the following problems remain unsolved due to the division by the fundamental period and integration in the range of the fundamental period.

(Problem 1) Discontinuity occurs along the frequency axis.

(Problem 2) Step-like discontinuity occurs along the time axis.

Solutions to these problems will be described below.

First, Problem 1 relates to discontinuity due to the fundamental period around F0=318.6284 Hz, 1.25 KHz, 1.7 KHz, etc. as shown in FIG. 12. For flexible manipulation such as transformation of the group delay information, the group delay is not usable as it is. Then, the group delay is normalized in the range of (−π, π), and then is converted with sin and cos functions. As a result, the discontinuity can continuously be grasped. Specifically, the group delay can be calculated as follows <Formula (6)>

$$g_\pi(f,t)=(g(f,t)\times 2\pi)-\pi \tag{5}$$

$$g_x(f,t)=\cos(g_\pi(f,t)) \tag{6}$$

$$g_y(f,t)=\sin(g_\pi(f,t)) \tag{7}$$

Next, Problem 2 is similar with a problem with the estimation of spectral envelopes. This is due to the periodic occurrence of waveform driving. Here, in order to solve the problem for the purpose of sound analysis and synthesis, it is convenient if the period continuously changes. For this purpose, $g_x(f,t)$ and $g_y(f,t)$ are smoothed in advance.

Last, as with the spectral envelopes, since components of frequency bins under F0 are not reliably estimated in many cases, the normalized group delays of frequency bins under F0 are replaced with the value of frequency bin at F0.

Figure 15:
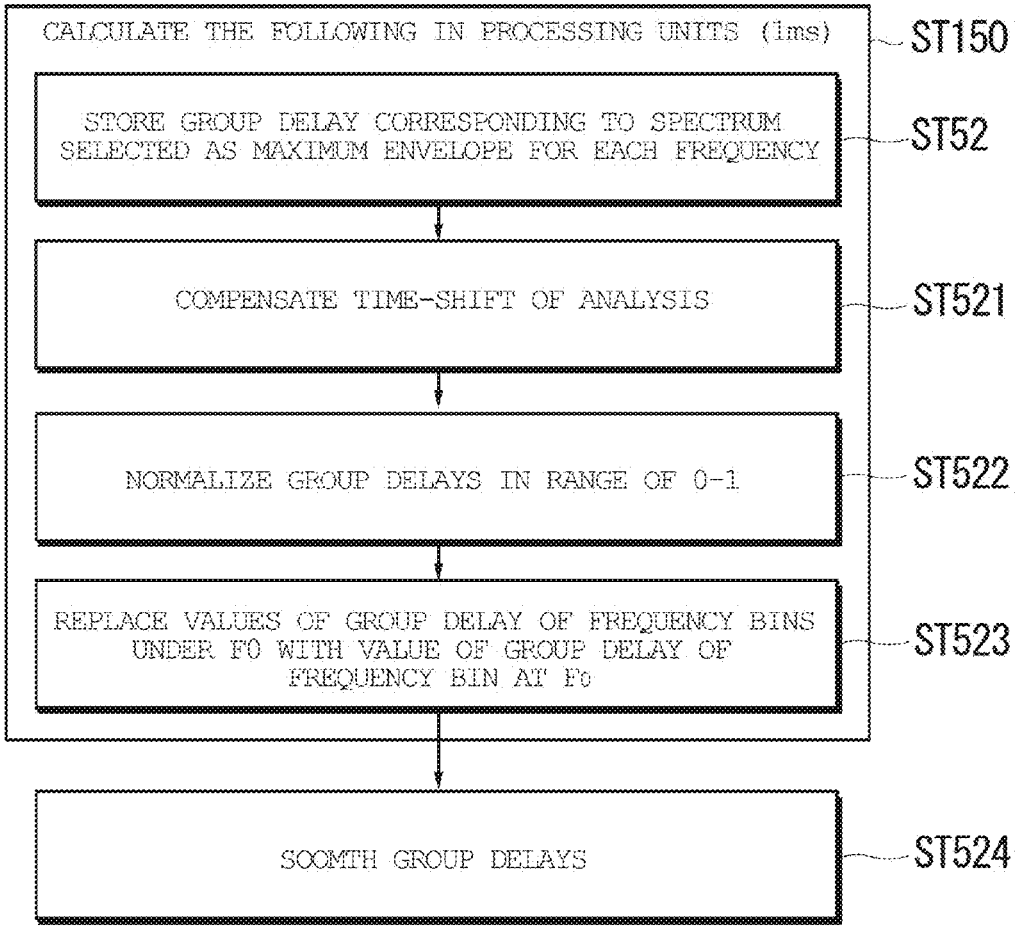
FIG. 15 is a flowchart showing an example algorithm of a computer program used to obtain a group delay GD for sound synthesis from F0-adaptive group delays.
Figure 16:
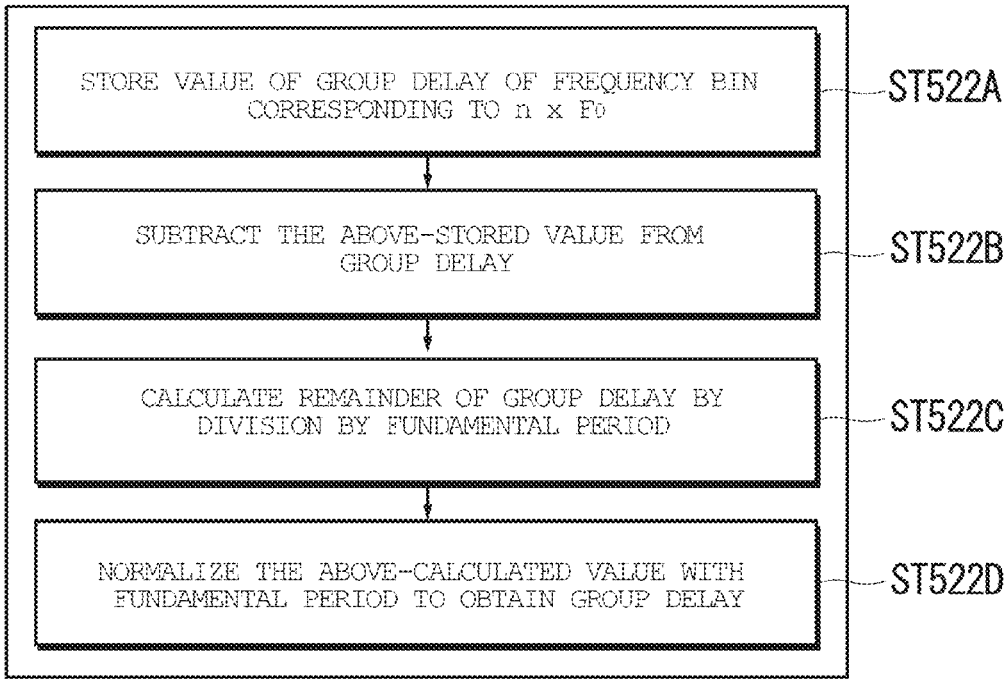
FIG. 16 sows an algorithm of normalization.

Now, how to implement the group delay integration section 11 which operates as described above by using a program installed on a computer will be described below. FIG. 15 is a flowchart showing an example algorithm of a computer program used to obtain a group delay GD for sound synthesis from a plurality of F0-adaptive group delays (as indicated with $Z_1$-$Z_n$ in FIG. 5). In this algorithm, step ST150 executed every 1 ms includes step ST52 of FIG. 9. Namely, at step ST52, group delays corresponding to overlapped spectra selected as the maximum envelopes are stored by frequency. Then, at step ST521, time-shift of analysis is compensated (see FIG. 5). The group delay integration section 11 stores by frequency group delays in the frames corresponding to the maximum envelopes for the respective frequency components of the overlapped spectra, and compensate the time-shift of analysis for the stored group delays. This is because the group delays spread along the time axis (at an interval) according to the fundamental period corresponding to F0. Next, at step ST522, the group delays for which the time-shift has been compensated are normalized in the range of 0-1. This normalization follows the steps as shown in detail in FIG. 16. FIG. 17 illustrates various states of group delay in normalization steps. First, the group delay value of frequency bin corresponding to nxF0 is stored (see step ST522 as shown in Fig.17A). Next, the stored value is subtracted from the group delay (at step ST522B as shown in FIG. 17B). Then, based on the result of the above subtraction, the remainder of the group delay is calculated by division by the fundamental period (at step ST522C as shown in FIG. 17C). Next, the result of the above calculation is normalized (divided) by the fundamental period to obtain a normalized group delay (at step ST522D as shown in FIG. 17D). In this manner, normalizing the group delay along the time axis may remove the effect of F0, thereby obtaining a transformable group delay according to F0 at the time of resynthesis (resynthesization). The group delays are normalized as follows. At step ST523 of FIG. 15, the group delay for sound synthesis is based on the group delays which have been obtained by replacing the group delay values of frequency bins under F0 with the value of frequency bin at F0. This is because the estimated group delays of frequency bins under F0 are unreliable. With such replacement, the estimated group delays of frequency bins under F0 become reliable, thereby increasing the naturalness of hearing impression of synthesized sound. The replaced group delays may be used, as they are, for sound synthesis. In this embodiment, however, at step ST524, the replaced group delays obtained every 1 ms are smoothed. This is because it is convenient if the group delay continuously changes for the purpose of sound analysis and synthesis.

Figure 18:
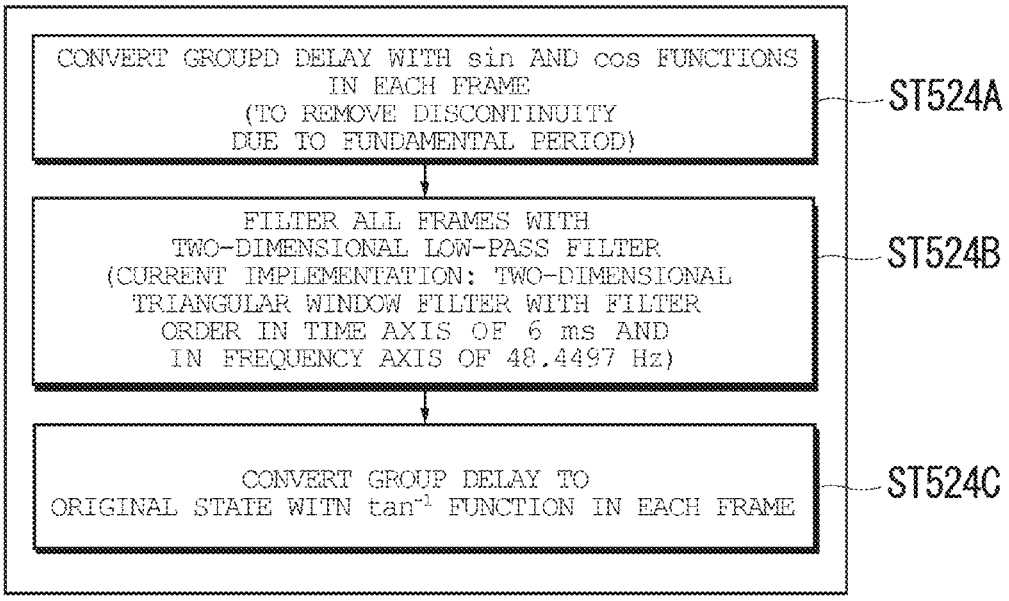
FIG. 18 illustrates an algorithm of smoothing.

In smoothing the group delays, as shown in FIG. 18, the group delay replaced for each frame is converted with sin and cos functions to remove discontinuity due to the fundamental period at step ST524A. Next, at step ST524B, all the frames are subjected to two-dimensional low-pass-filtering. Following that, at step ST524C, the group delay for each frame is converted to an original state with $\tan^{-1}$ function to obtain a group delay for sound synthesis. The conversion of the group delay with sin and cos functions is performed for the convenience of two-dimensional low-pass filtering. The formulae used in this calculation are the same as those used in sound synthesis as described later.

The spectral envelopes and group delays obtained in the manner described so far are stored in a memory 13 of FIG. 1.

[Sound Synthesis Based on Spectral Envelopes and Group Delays]

Figure 19:
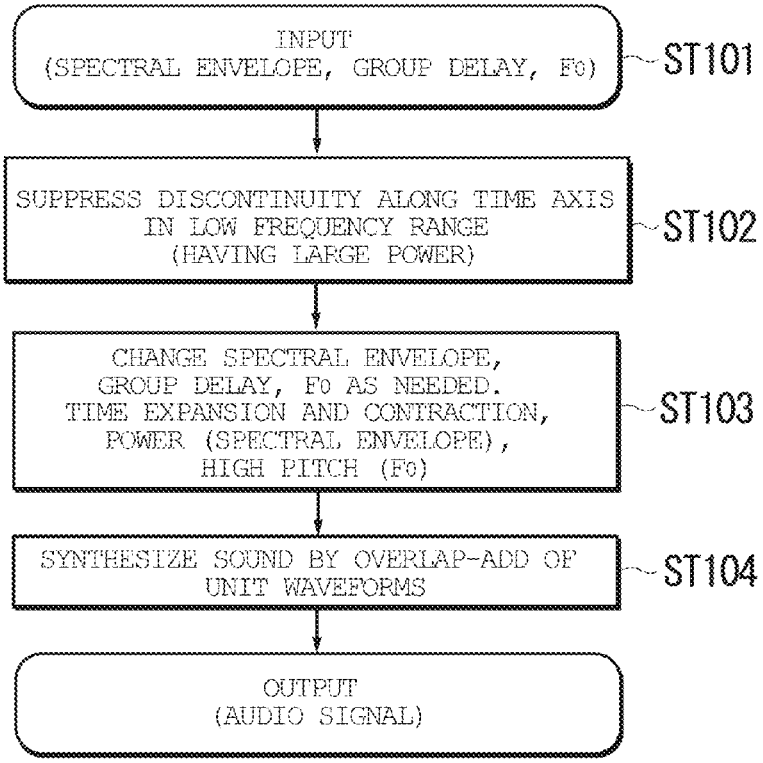
FIG. 19 is a flowchart showing an example algorithm of a computer program used to implement an audio signal synthesis system according to the present invention.
Figure 20:
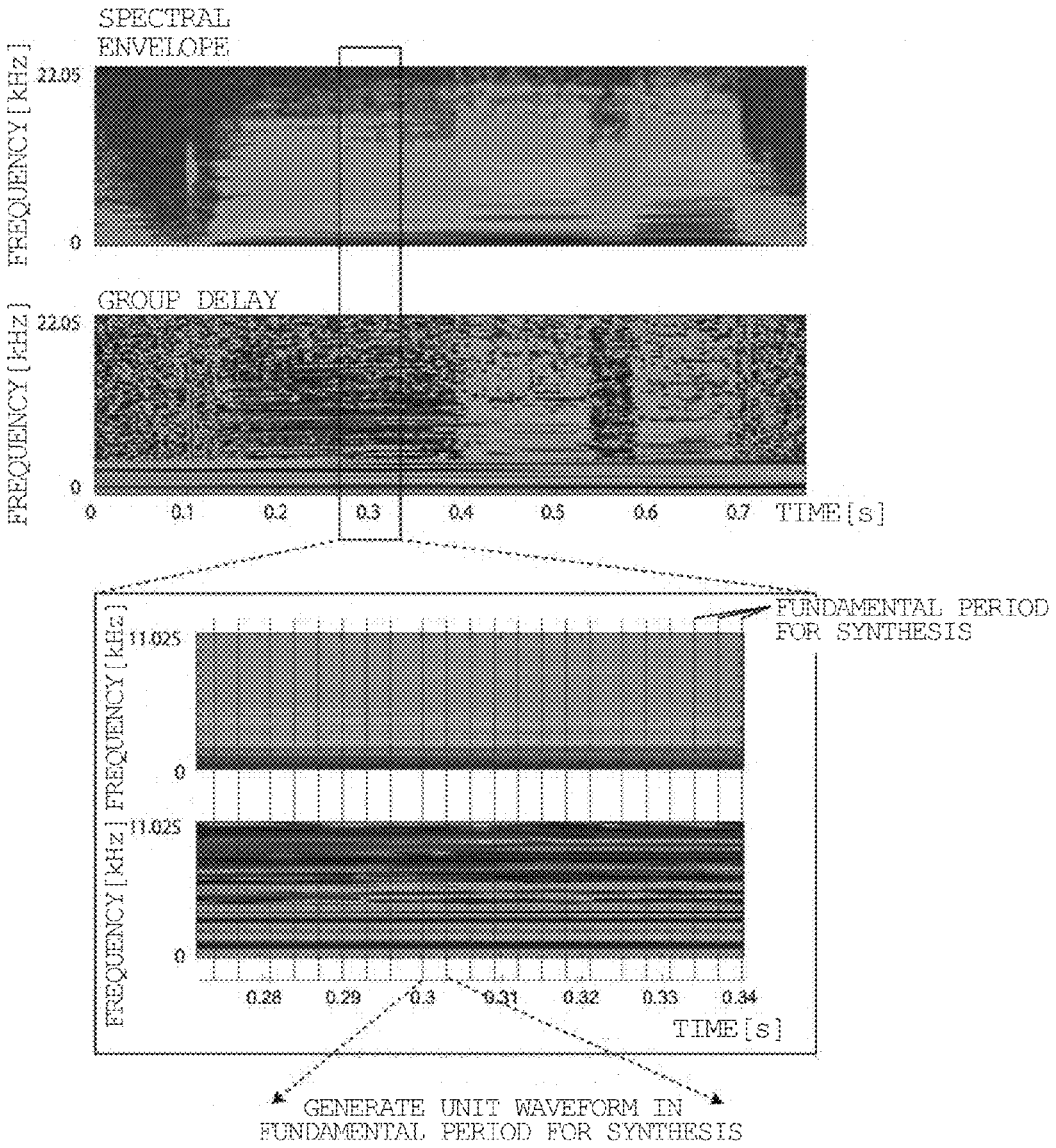
FIG. 20 shows a part of waveforms for explanation of audio signal synthesis steps.
Figure 21:
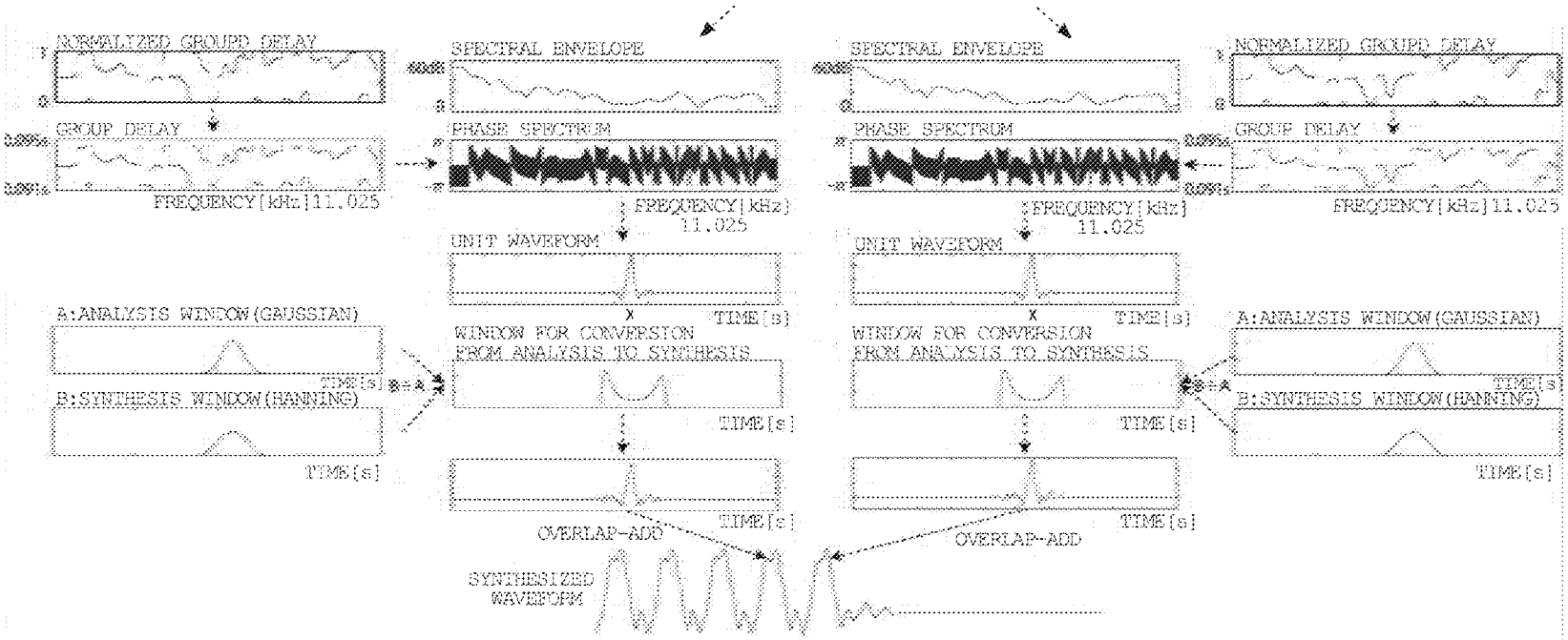
FIG. 21 shows the remaining part of the waveforms for explanation of the audio signal synthesis steps.

In order to use in sound synthesis the spectral envelopes and normalized group delays obtained as described so far, as with conventional sound analysis and synthesis systems, expansion and contraction of the time axis and amplitude control are performed and F0 for sound synthesis is specified. Then, a unit waveform is sequentially generated based on the specified F0 and spectral envelopes for sound synthesis as well as the normalized group delays. Overlap-add calculation is performed on the generated unit waveforms, thereby synthesizing sound. An audio signal synthesis system 2 of FIG. 1 comprises a reading section 15, a conversion section 17, a unit waveform generation section 19, and a synthesis section 21 as primary elements as well as a discontinuity suppression section 23 and a compensation section 25 as additional elements. FIG. 19 is a flowchart showing an example algorithm of a computer program used to implement an audio signal synthesis system according to the present invention. FIGS. 20 and 21 respectively show waveforms for explanation of audio signal synthesis steps.

As shown in FIG. 20, the reading section 15 reads out the spectral envelopes and group delays for sound synthesis from a data file stored on the memory 13. Reading out is performed in a fundamental period 1/F0 for sound synthesis which is a reciprocal of F0 for sound synthesis. The data file has stored the spectral envelopes and group delays for sound synthesis as estimated by the estimation system 1 at a predetermined interval. The conversion section 17 converts the read-out group delays into phase spectra as shown in FIG. 20. Also as shown in FIG. 20, the unit waveform generation section 19 generates unit waveforms based on the read-out spectral envelopes and the phase spectra. As shown in FIG. 21, the synthesis section 21 outputs a synthesized audio signal obtained by performing overlap-add calculation on the generated unit waveforms in the fundamental period for sound synthesis. According to this audio signal synthesis system, group delays are generally reproduced for sound synthesis, thereby attaining natural synthesis quality.

Figure 22:
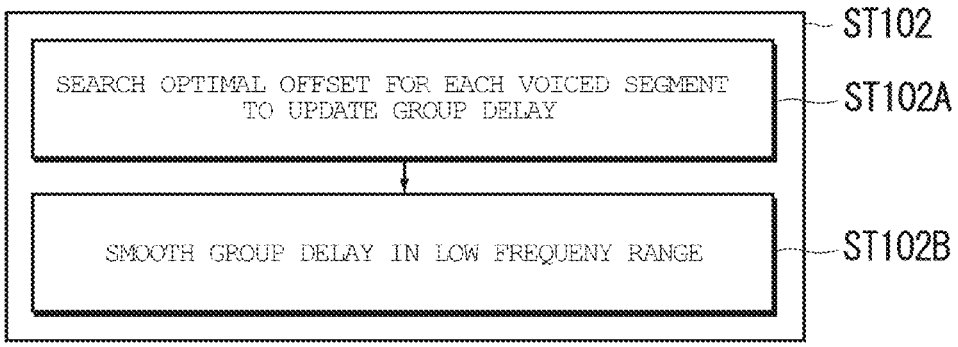
FIG. 22 shows an algorithm of a program for suppressing an occurrence of discontinuity along the time axis in a low frequency range.
Figure 23:
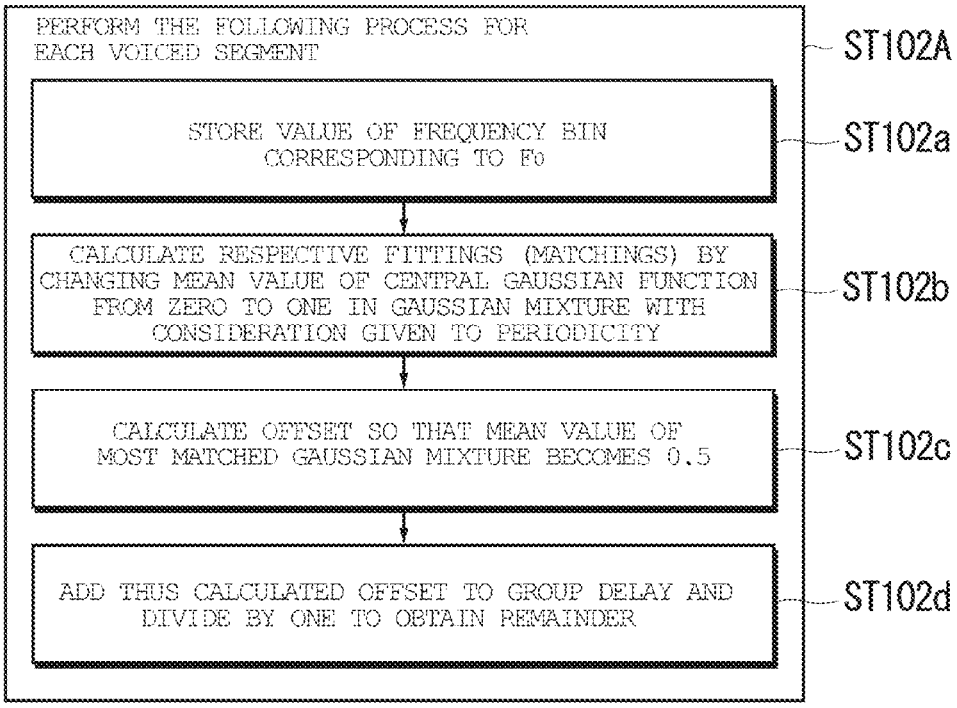
FIG. 23 shows an algorithm of a program for updating the group delay.
Figure 24:
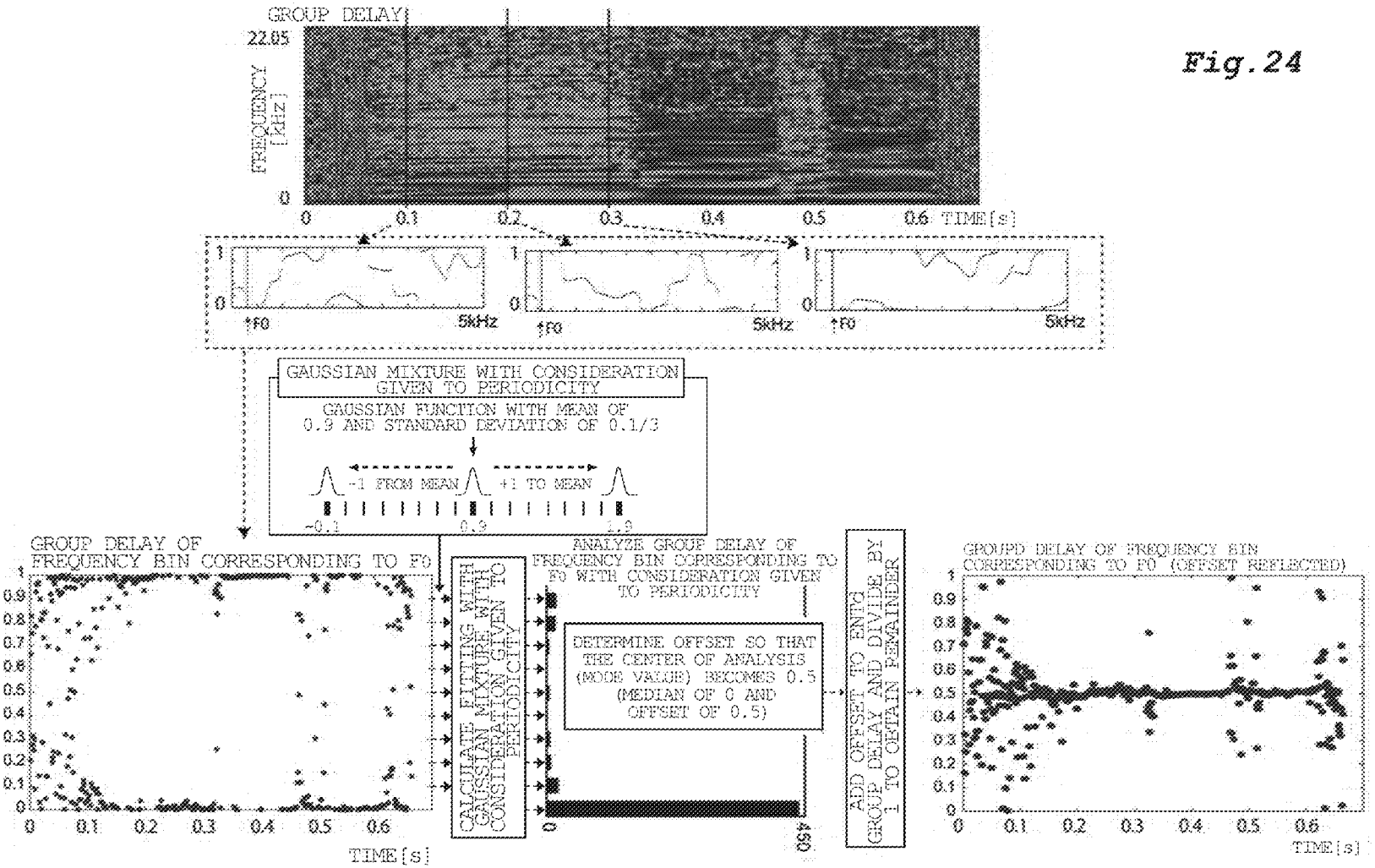
FIG. 24 illustrates group delay updating.
Figure 25:
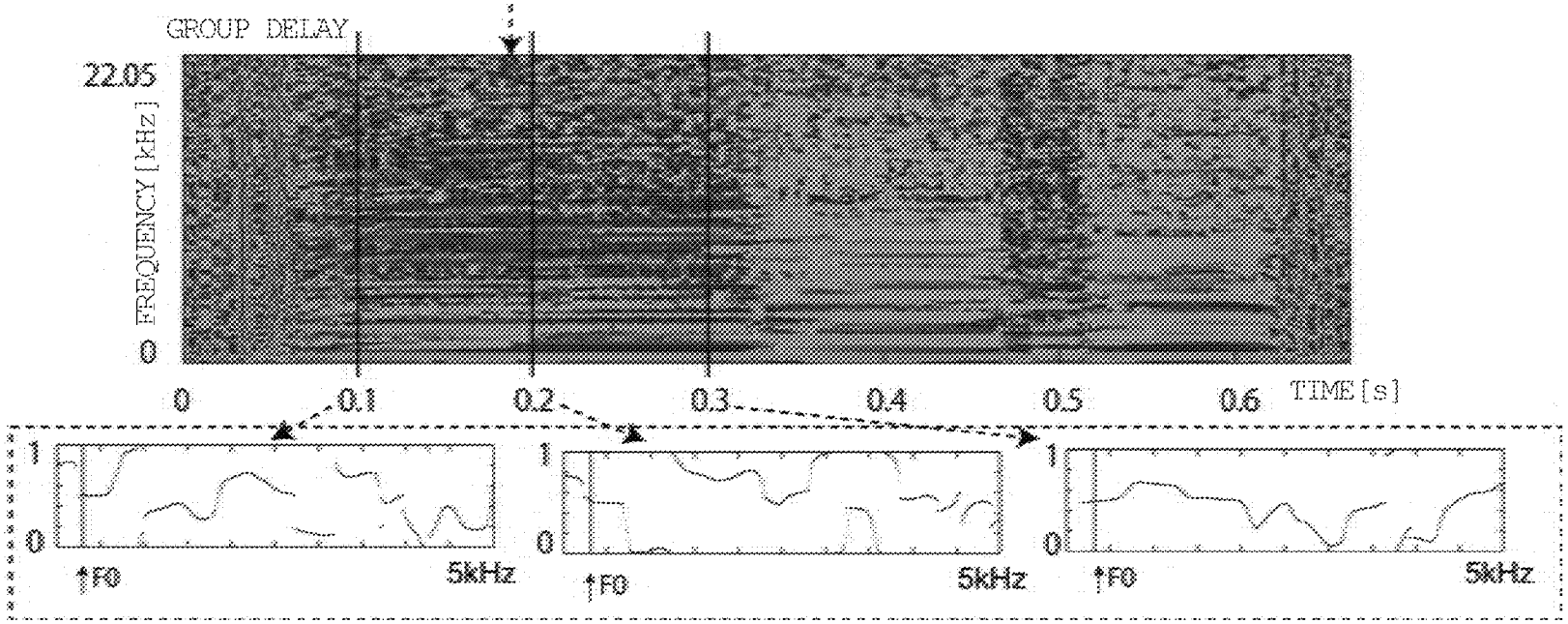
FIG. 25 illustrates group delay updating.

In the embodiment as shown in FIG. 1, the audio signal synthesis system further comprises a discontinuity suppression section 23 operable to suppress an occurrence of discontinuity along the time axis in the low frequency range of the read-out group delays before the conversion section 17 performs the conversion, and a compensation section 25. The discontinuity suppression section 23 is implemented at step ST 102 of FIG. 19. As shown in FIG. 22, an optimal offset for each voiced segment is searched to update the group delays at step ST102A in step ST120, and the group delays are smoothed in the low frequency range at step ST102B in step ST120. The updating of the group delays shown at step ST102A is implemented by the steps shown in FIG. 23. FIGS. 24 and 25 are used to explain the updating of the group delays. First, the discontinuity suppression section 23 re-normalizes the group delays by adding an optimal offset to the group delay for each voiced segment for updating (at step ST102A of FIG. 22), and then smoothes the group delays in the low frequency range (at step ST102B of FIG. 22). As shown in FIG. 23, the first step ST102A extracts a value of frequency bin at F0 for sound synthesis (see step ST102*a* and FIG. 23). Next, the fitting (matching) with the mean value of the central Gaussian function is performed by changing the mean value of the central Gaussian function in the range of 0-1 in the Gaussian mixture with consideration given to periodicity (see step ST102*b* and FIG. 23). Here, the Gaussian mixture with consideration given to periodicity is a Gaussian function with the mean value of 0.9 and the standard deviation of 0.1/3. As shown in FIG. 24, the fitting results can be represented as a distribution which takes account of the group delays of frequency bin at F0. An offset for the group delays is determined such that the center of the distribution (the mode value) may be 0.5 (at step ST102*c* of FIG. 23). Next, a remainder is calculated by adding the offset to the group delay and dividing by 1 (one) (at step ST102*d* of FIG. 23). FIG. 25 shows example group delays wherein a remainder is calculated by adding the offset to the group delay and dividing by 1 (one).

In this manner, the group delay of frequency bin at F0 reflects the offset as shown in FIG. 24.

Figure 26:
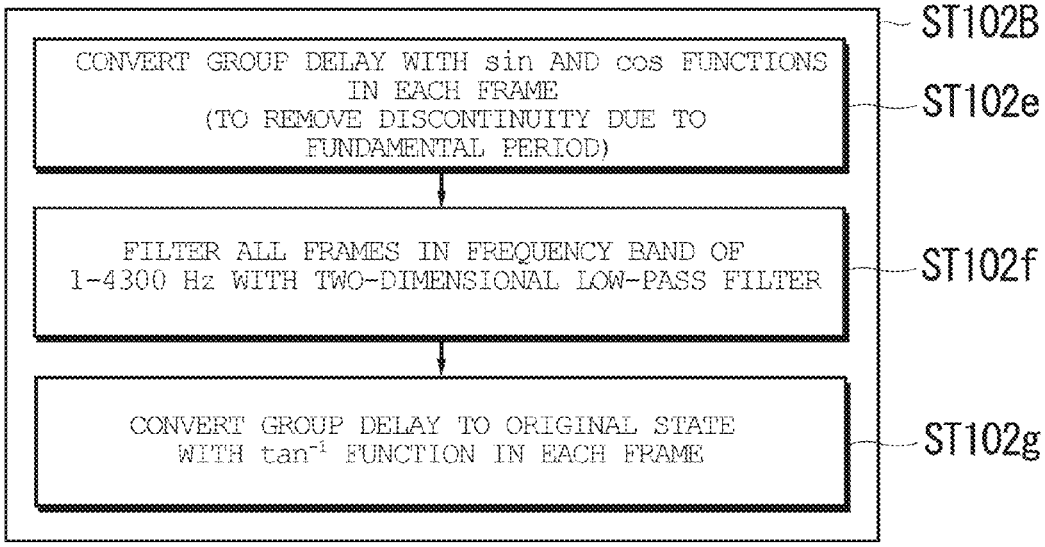
FIG. 26 is a flowchart showing an example algorithm of smoothing in a low frequency range.
Figures 27A, 27B, 27C:
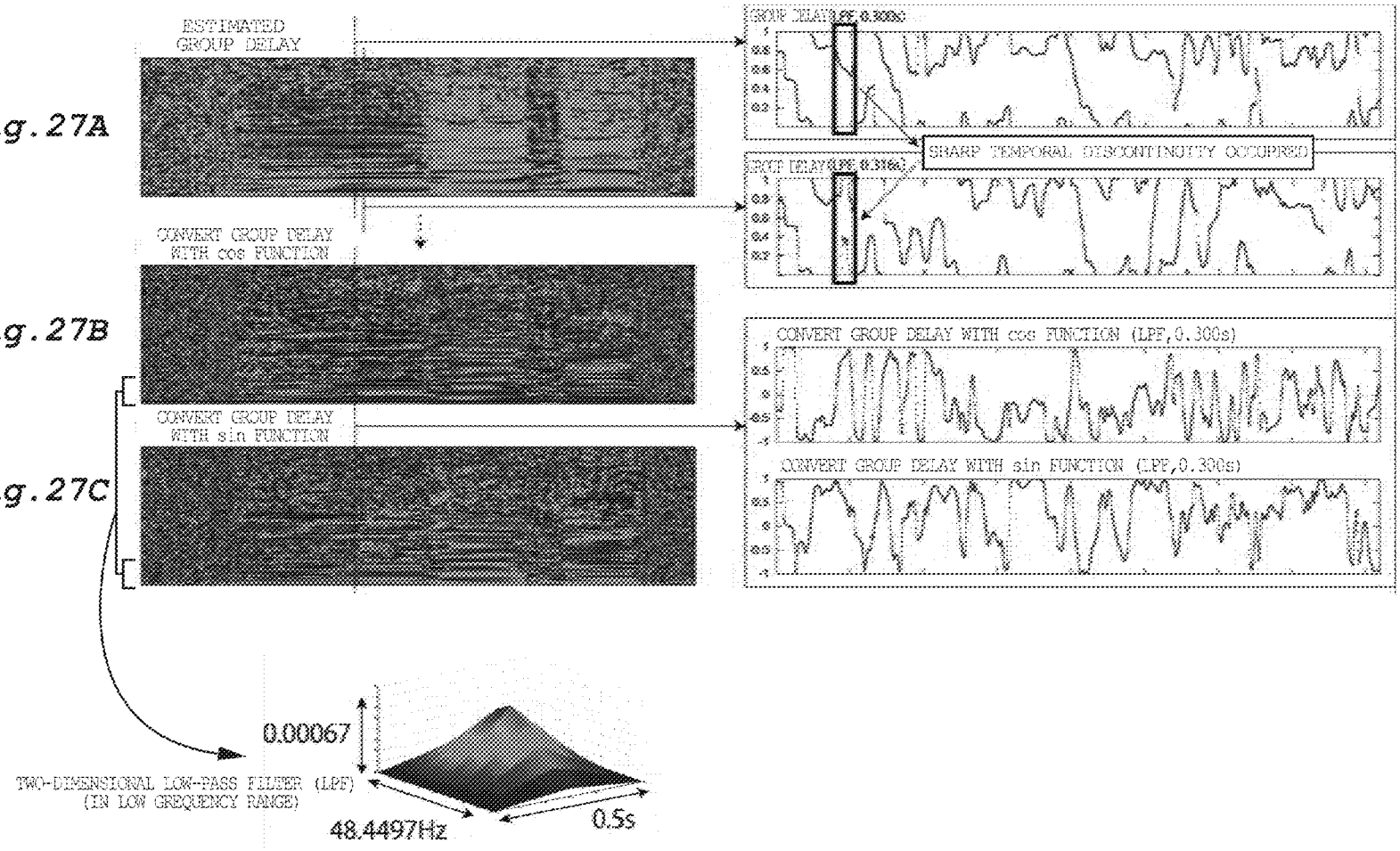
FIGS. 27A to 27C illustrate a part of an example smoothing process in step ST102B.
Figures 28D, 28E, 28F:
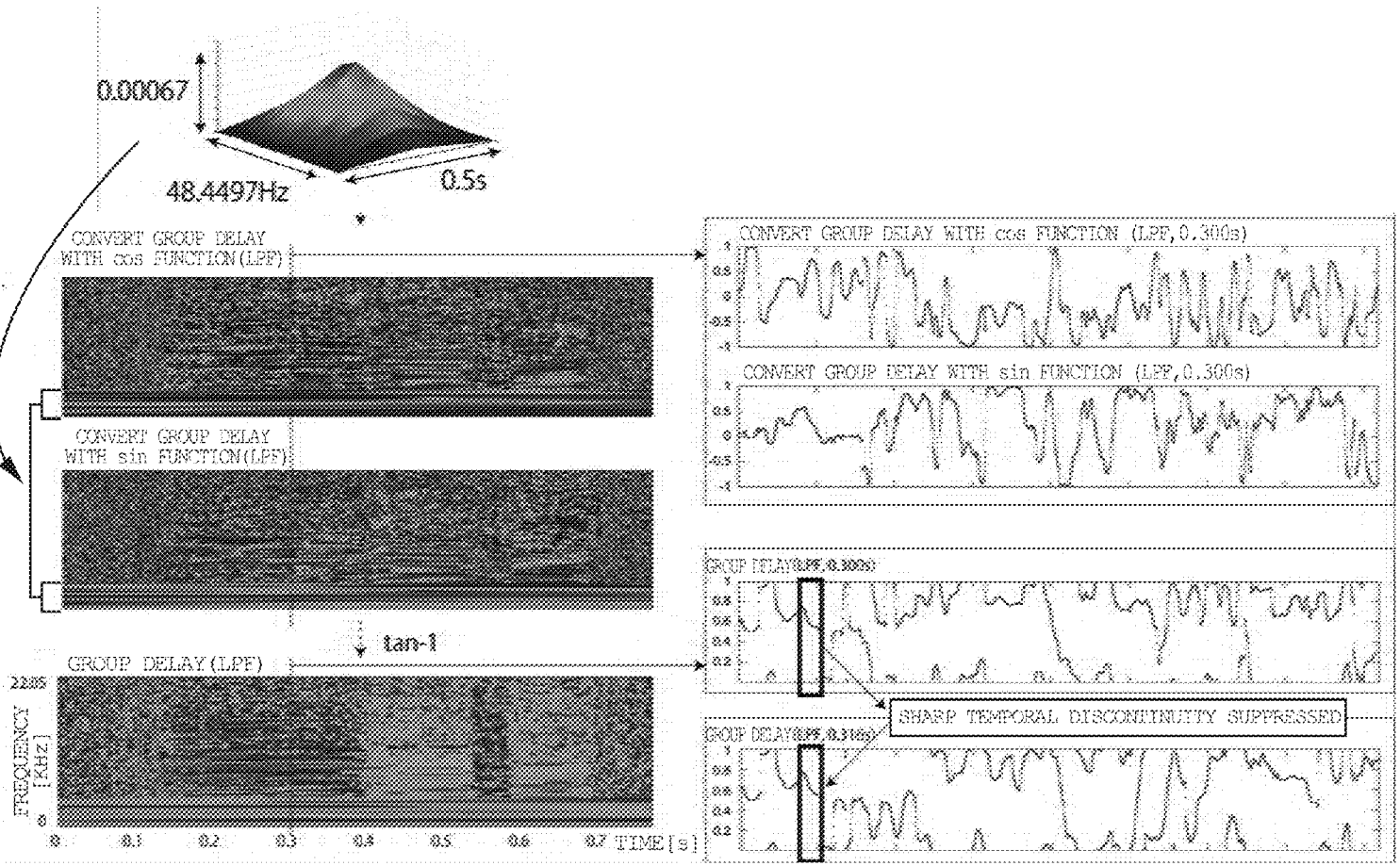
FIGS. 28D to 28F illustrate the remaining part of the example smoothing process in step ST102B.

The discontinuity suppression section 23 re-normalizes the group delays by adding the optimal offset to the group delay for each voiced segment, and then smoothes the group delays in the low frequency range at step ST102B. FIG. 26 is a flowchart showing an example algorithm for smoothing in the low frequency range. FIGS. 27A to 27C and FIGS. 28D to 28F sequentially illustrate an example smoothing process at step ST102B. In the smoothing process, the read-out group delays are converted with sin function and cos functions for the frames in which discontinuity is suppressed at step ST102*e* of FIG. 26 (see FIGS. 27B and 27C). Then, at step ST102*f* of FIG. 26, two-dimensional low-pass filtering is performed on the frames in the frequency band of 1-4300 Hz. For example, a two-dimensional triangular window filter with the filter order in the time axis 0.6 ms and the filter order in the frequency axis of 48.4497 Hz may be used as a two-dimensional low-pass filter. After the filtering is completed, the group delays, which have been converted with sin and cos functions, are converted to an original state with $\tan^{-1}$ function at step ST102*g* (see FIGS. 27D-27F and Formula (9)). With this operation, even if sharp discontinuity occurs along the time axis, the sharp discontinuity is removed. As with this embodiment, smoothing the group delays by the discontinuity suppression section 23 can eliminate the instability or unreliability of the group delays in the low frequency range.

In this embodiment, the audio signal synthesis system further comprises a compensation section 25 operable to multiply the group delays by the fundamental period for sound synthesis as a multiplier coefficient after the conversion section 17 of FIG. 1 converts the group delays or before the discontinuity suppression section 23 of FIG. 1 suppresses the discontinuity. With the compensation section 25, the group delays spreading (having an interval) along the time axis according to the fundamental period corresponding to F0 can be normalized along the time axis, and higher accuracy phase spectra can be obtained from the conversion section 17.

Figure 29:
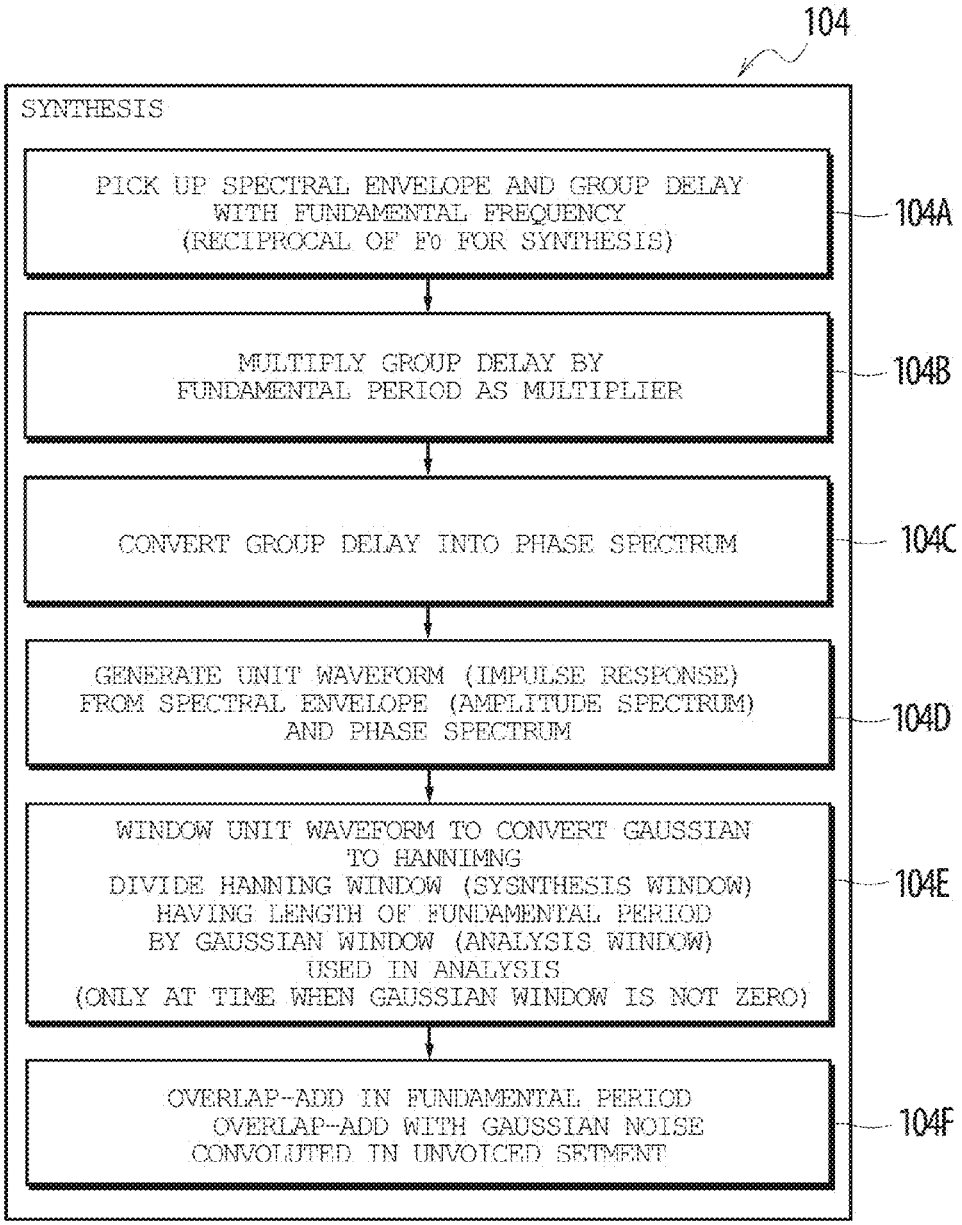
FIG. 29 is a flowchart showing a detailed algorithm of step ST104.

In this embodiment, the unit waveform generation section 19 generates unit waveforms by converting the analysis window to the synthesis window and windowing the unit waveform by the synthesis window. The synthesis section 21 performs overlap-add calculation on the generated unit waveforms in the fundamental period. FIG. 29 is a flowchart showing a detailed algorithm of step ST104 of FIG. 19. First, at step ST104A, the smoothed group delays and spectral envelopes are picked up or taken out in the fundamental period (at F0 for sound synthesis). Next, at step ST104B, the group delays are multiplied by the fundamental period as a multiplier. The compensation section 25 is implemented at step ST104B. Next, at step ST104C, the group delays are converted to phase spectra. The conversion section 17 is implemented at step ST104C. Then, at step St104D, the unit waveforms (impulse responses) are generated from the spectral envelopes (amplitude spectra) and the phase spectra. At step ST104E, the unit waveforms thus generated are windowed by a window for converting the Gaussian window (analysis window) to a Hanning window (synthesis window) with the amplitude of 1 (one) when adding up the Hanning window. Thus, the unit waveforms windowed by the synthesis window are obtained. Specifically, the Hanning window with the length of the fundamental period is divided by the Gaussian window (analysis window) used in the analysis to generate a "window" for the conversion. Note that the "window" has a value only at the time that the Gaussian window has a value of not 0 (non-zero). At step ST104F, the overlap-add calculation is performed on a plurality of compensated unit waveforms in the fundamental period (a reciprocal of F0) to generate a synthesized audio signal. Preferably, at step ST104F, Gaussian noise is convoluted and then the overlap-add calculation is performed in unvoiced segments. Although windowing does not have effect to transform original sounds if a Hanning window is used as the analysis window, in this embodiment, a Gaussian window is used for analysis in order to improve the temporal and frequency resolutions and to reduce the sidelobe effect (because the low-order sidelobe effect reduction is lower in the Hanning window than in the Gaussian window).

The use of the unit waveforms thus compensated with the synthesis window can help improve the naturalness of hearing impression of synthesized sound.

The calculation performed at step ST102B will be described below in detail. The group delay is finally dealt with after the following calculation has been performed to convert the group delay to g(f,t) from $g_x(f,t)$ and $g_y(f,t)$ converted with sin and cos functions respectively.

⟨Formula (7)⟩

$$g(f,t) = \frac{(g_\pi(f,t)+\pi)}{2\pi} \tag{8}$$

$$g_\pi(f,t) = \begin{cases} \tan^{-1}\left(\frac{g_y(f,t)}{g_x(f,t)}\right) & (g_x(f,t) > 0) \\ \tan^{-1}\left(\frac{g_y(f,t)}{g_x(f,t)}\right) + \pi & (g_x(f,t) < 0) \\ (3\times\pi)/2 & (g_y(f,t) < 0,\ g_x(f,t) = 0) \\ \pi/2 & (g_y(f,t) > 0,\ g_x(f,t) = 0) \end{cases} \tag{9}$$

Where the formant frequency fluctuates, the contour of an estimated group delay may sharply change, thereby significantly affecting the synthesis quality when the power is large in the low frequency range. It can be considered that this is caused when the fluctuation due to F0 as described before (see FIG. 8) occurs at a higher speed than F0 in a certain frequency band. Referring to FIG. 14B, for example, the fluctuation around 500 Hz is faster than around 1500 Hz. In the proximity of the center of FIG. 14B, the contour of the group delay changes, and the unit waveforms accordingly changes. In this embodiment, a new common offset is added to the group delay and is divided by 1 (one) to obtain a remainder (the group delay is normalized) in the same voiced segment such that discontinuity along the time axis may hardly occur in the low frequency range of the group delay g(f,t). Then, two-dimensional low-pass filtering with a long time constant is performed in the low frequency range to eliminate such instant fluctuation.

[Experiments]

Regarding the accuracy of estimating the spectral envelopes by the method according to this embodiment of the present invention, the proposed method was compared with two previous methods known to have high accuracy, STRAIGHT (refer to Non-Patent Document 27) and TANDEM-STRAIGHT (refer to Non-Patent Document 28). An unaccompanied male singing sound (solo vocal) was taken from the RWC Music Database (Goto, M., Hashiguchi, H., Nishimura, T., and Oka, R., "RWC Music Database for Experiments: Music and Instrument Sound Database" authorized by the copyright holders and available for study and experiment purpose, Information Processing Society of Japan (IPS) Journal, Vol. 45, No. 3, pp. 728-738 (2014) ((Music Genre: RWC-MDB-G-2001 No. 91). A female spoken sound was taken from the AIST Humming Database (E008) (Goto, M. and Nishimura, T., "AIST Hamming Database, Music Database for Singing Research", IPS Report, 2005-MUS-61, pp. 7-12 (2005)). Instrument sounds, piano and violin sounds, were taken from the RWC Music Database as described above (Piano: RWC-MDB-I-20001, No. 01, 011PFNOM) and (Violin: RWC-MDB-I-2001, No. 16, 161VLGLM). All spectral envelopes were represented with 2049 frequency bins (4096 FFT length) which are frequently used in STRAIGHT, and the unit time of analysis was set to 1 ms. In the embodiment described so far, the temporal resolution means the discrete time step of executing the integration process every 1 ms in the multi-frame integration analysis.

Regarding the estimation of group delays, the further analysis results of the synthesized sound with group delays reflected were compared with the analysis results of natural sound. Here, not as with the estimation experiments of spectral envelopes, 4097 frequency bins (FFT length of 8192) were used in experiments in order to secure the estimation accuracy of group delays.

[Experiment A: Comparison of Spectral Envelopes]

In this experiment, the analysis results of natural sound were compared with the STRAIGHT spectral envelopes.

Figure 30:
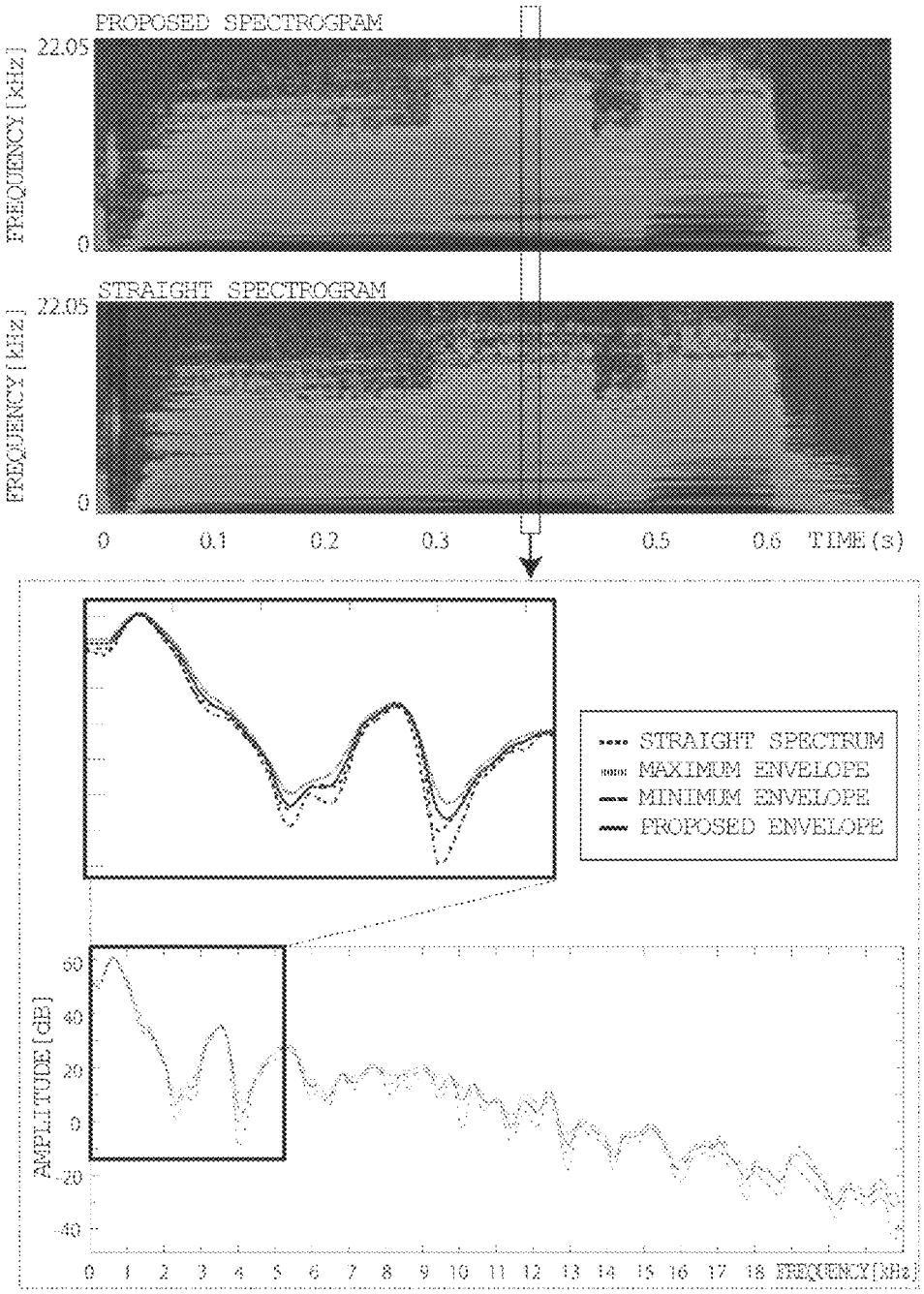
FIG. 30 illustrates comparison between a spectrogram according to the present invention (in the top) and a STRAIGHT spectrogram (in the middle), and their respective spectral envelopes at time 0.4 sec (in the bottom).

In FIG. 30, STRAIGHT spectrogram and the proposed spectrogram are shown correspondingly and the spectral envelopes at time 0.4 sec. are overlapped for illustration purpose. The STRAIGHT spectrum lies between the proposed maximum and minimum envelopes. It is almost approximate or similar to the proposed spectral envelope. Further, sound was synthesized from the proposed spectrogram by STRAIGHT using the aperiodic components estimated by STRAIGHT. Hearing impression of the synthesized sound was comparable, not inferior to the re-synthesis from the STRAIGHT spectrogram.

[Experiment B: Reproduction of Spectral Envelopes]

In this experiment, the accuracy of spectral envelope estimation was evaluated using synthesized sound with known spectral envelopes and F0. Specifically, in this experiment were used the analyzed and synthesized sound by STRAIGHT from the natural sound and instrument sound samples as described before and sounds synthesized by a cascade-type Klatt synthesizer (Klatt, D. H., "Software for A Cascade/parallel Formant Synthesizer", J. Acoust. Soc. Am., Vol. 67, pp. 971-995 (1980)) with the spectral envelopes being parameter controlled.

A list of parameters given to the Klatt synthesizer is shown in Table.

TABLE 1

| Symbol | Name | Value (Hz) |
|---|---|---|
| F0 | Fundamental frequency | 125 |
| F1 | First formant frequency | 250-1250 |
| F2 | Second formant frequency | 750-2250 |
| F3 | Third formant frequency | 2500 |
| F4 | Fourth formant frequency | 3500 |
| F5 | Fifth formant frequency | 4500 |
| B1 | First formant bandwidth | 62.5 |
| B2 | Second formant bandwidth | 62.5 |

TABLE 1-continued

| Symbol | Name | Value (Hz) |
|---|---|---|
| B3 | Third formant bandwidth | 125 |
| B4 | Fourth formant bandwidth | 125 |
| B5 | Fifth formant bandwidth | 125 |
| FGP | Glottal resonator frequency | 0 |
| BGI | Glottal resonator bandwidth | 100 |

Here, the values of the first and second formant frequencies (F1 and F2) were set to those shown in Table 2 to generate spectral envelopes. Sinusoidal waves were overlapped with the fundamental frequency of 125 Hz to synthesize six kinds of sounds from the generated spectral envelopes.

TABLE 2

| ID | F1 (Hz) | F2 (Hz) |
|---|---|---|
| K01 | 250 | 750 |
| K02 | 250 | 1500 |
| K03 | 500 | 1500 |
| K04 | 1000 | 1500 |
| K05 | 1000 | 2000 |
| K06 | 500 | 2000 |

The following log-spectral distance (LSD) was used in the evaluation of estimation accuracy. Here, T stands for the number of voiced frames, F for the number of frequency bins ($=F_H-F_L+1$), $(F_L,F_H)$ for the frequency range for the evaluation, and $S_g(t,f)$ and $S_e(t,f)$ for the ground-truth spectral envelope and an estimated spectral envelope, respectively. Further, $\alpha(t)$ stands for a normalization factor determined by minimizing an error defined as a square error $\epsilon^2$ between $S_g(t,f)$ and $\alpha(t)S_e(t,f)$ in order to calculate the log-spectral distance.

⟨Formula (8)⟩

$$LSD = \frac{1}{T}\sum_{t=0}^{T-1}\frac{1}{F}\sum_{f=F_L}^{F_H}\left|20\log_{10}\frac{S_g(t,f)}{\alpha(t)\cdot S_e(t,f)}\right| \tag{10}$$

$$\alpha(t) = \frac{\sum_{f=F_L}^{F_H} S_g(t,f)S_e(t,f)}{\sum_{f=F_L}^{F_H} S_e(t,f)^2} \tag{11}$$

$$\epsilon^2 = \sum_{f=F_L}^{F_H}(S_g(t,f)-\alpha(t)S_e(t,f)) \tag{12}$$

Figure 31:
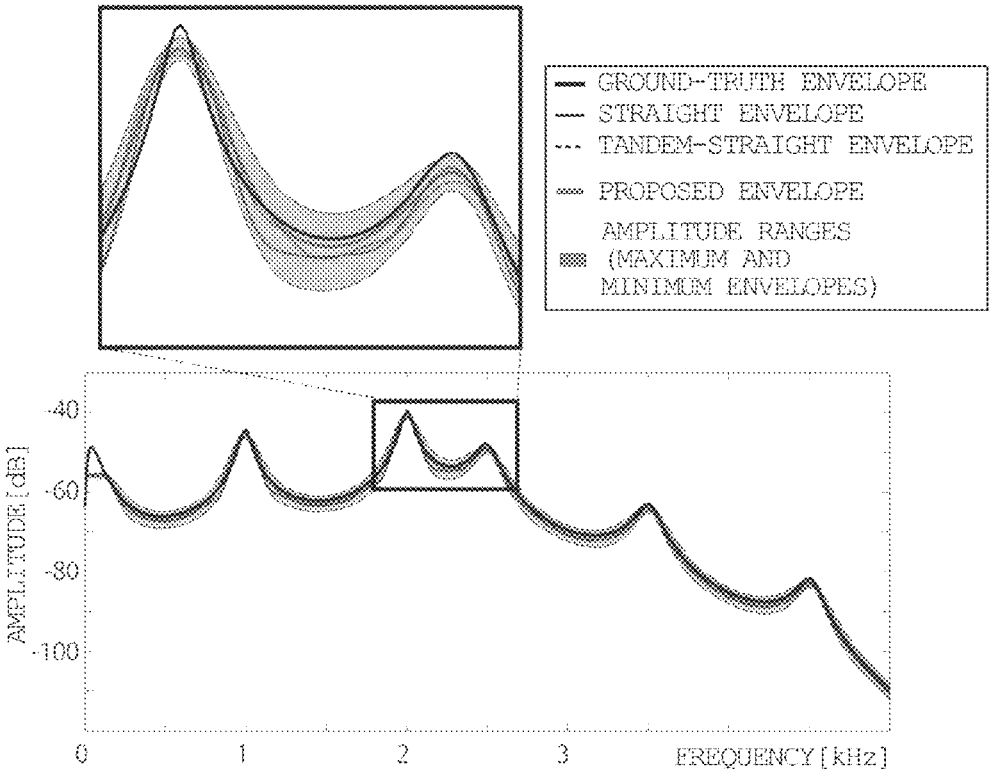
FIG. 31 illustrates comparison between a spectral envelope generated by a cascade-type Klatt synthesizer and spectral envelopes estimated by the method according to the present invention and by the conventional method.

Table 3 shows the evaluation results and FIG. 31 illustrates an example estimated spectral envelopes. The log-spectral distance of the spectral envelope estimated by the method according to this embodiment of the present invention was smaller than the one estimated by one of STRAIGHT and TANDEM-STRAIGHT in 13 samples out of 14 samples, and was smaller than those estimated by both of STRAIGHT and TANDEM-STRAIGHT in 8 samples out of 14 samples. As known from the results, it was confirmed that high-quality sound synthesis and high-accuracy sound analysis could be attained in this embodiment of the present invention.

TABLE 3

| Sound | Length | FL | FH | LSD (Log-Spectral Distance) [dB] | | |
|---|---|---|---|---|---|---|
| Type | (s) | [KHz] | [KHz] | STRAIGHT | TANDEM | Proposed |
| Singing (Male) | 6.5 | 0 | 6 | 1.0981 | 1.9388 | 1.4314 |
| Singing (Male) | 6.5 | 0 | 22.05 | 2.0682 | 2.3215 | 2.0538 |
| Singing (Female) | 4.6 | 0 | 6 | 2.1068 | 2.3434 | 2.0588 |
| Singing (Female) | 4.6 | 0 | 22.05 | 2.7937 | 2.7722 | 2.5908 |
| Instrument (Piano) | 2.9 | 0 | 6 | 3.6600 | 3.4127 | 3.1232 |
| Instrument (Piano) | 2.9 | 0 | 22.05 | 4.0024 | 3.5951 | 3.3649 |
| Instrument (Violin) | 3.6 | 0 | 6 | 1.1467 | 1.7994 | 1.3794 |
| Instrument (Violin) | 3.6 | 0 | 22.05 | 2.2711 | 2.3689 | 2.1012 |
| Klatt (K01) | 0.2 | 0 | 5 | 2.3131 | 1.6676 | 1.9491 |
| Klatt (K02) | 0.2 | 0 | 5 | 3.8462 | 1.5995 | 2.8278 |
| Klatt (K03) | 0.2 | 0 | 5 | 1.6764 | 1.4700 | 2.2954 |
| Klatt (K04) | 0.2 | 0 | 5 | 1.7053 | 1.2699 | 1.1271 |
| Klatt (K05) | 0.2 | 0 | 5 | 1.5759 | 1.2353 | 1.0643 |
| Klatt (K06) | 0.2 | 0 | 5 | 1.1712 | 1.2662 | 1.8197 |

[Experiment C: Reproduction of Group Delays]

Figure 32:
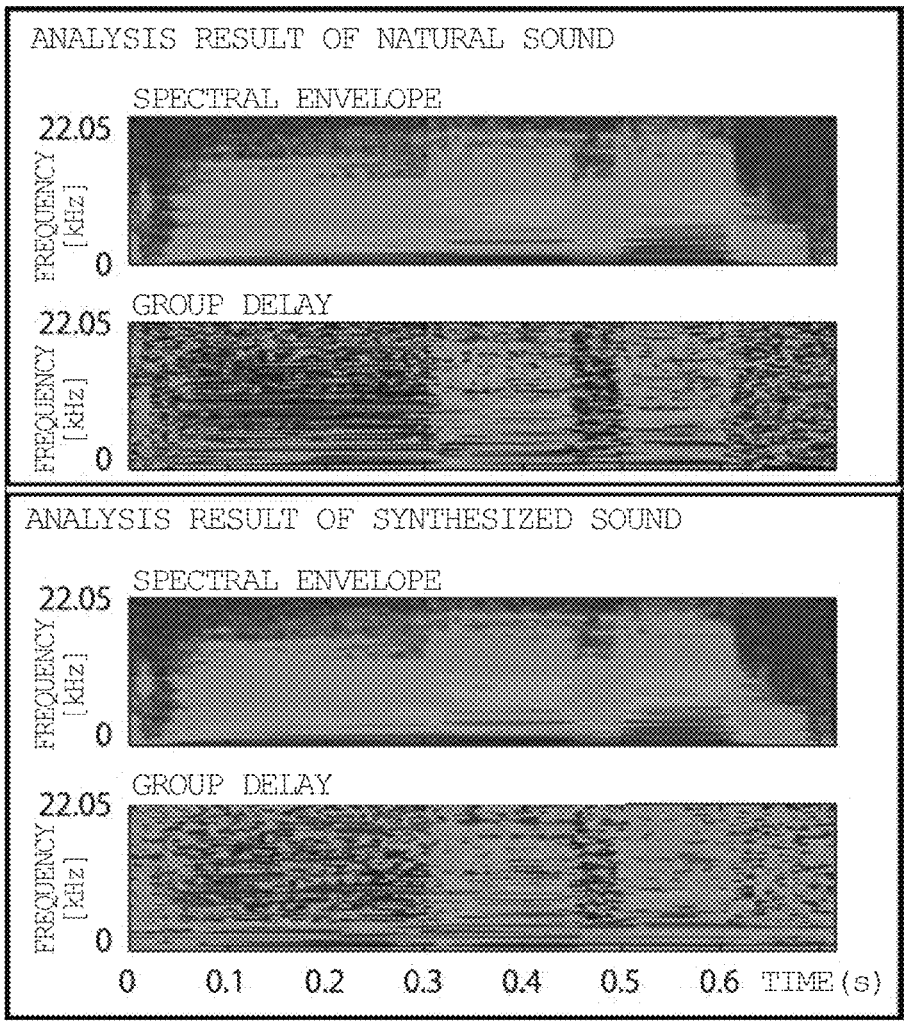
FIG. 32 illustrates analysis results of resynthesized sound according to the present invention.

FIG. 32 illustrates the experiment results obtained by estimating spectral envelopes and group delays and resynthesizing the sound using male unaccompanied singing voice according to this embodiment of the present invention. The low-pass filtering, which was performed generally or in the low frequency range, was observed in the group delays of the resynthesized sound. Generally, however, the group delays were reproduced and high-quality synthesis was attained, thereby providing natural hearing impression.

[Other Remarks]

In this embodiment, the amplitude ranges in which the estimated spectral envelopes lie were also estimated, which can be utilized in voice timber conversion, transformation of spectral contour, and unit-selection and concatenation synthesis, etc.

Figure 33A:
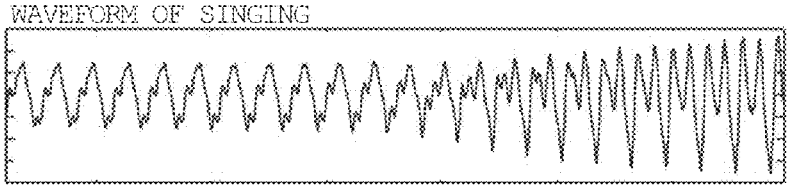
FIGS. 33A and 33B respectively illustrate a waveform of singing voice and its F0-adaptive spectral envelope and group delays corresponding to the maximum envelope peak in a relation manner.
Figure 33B:
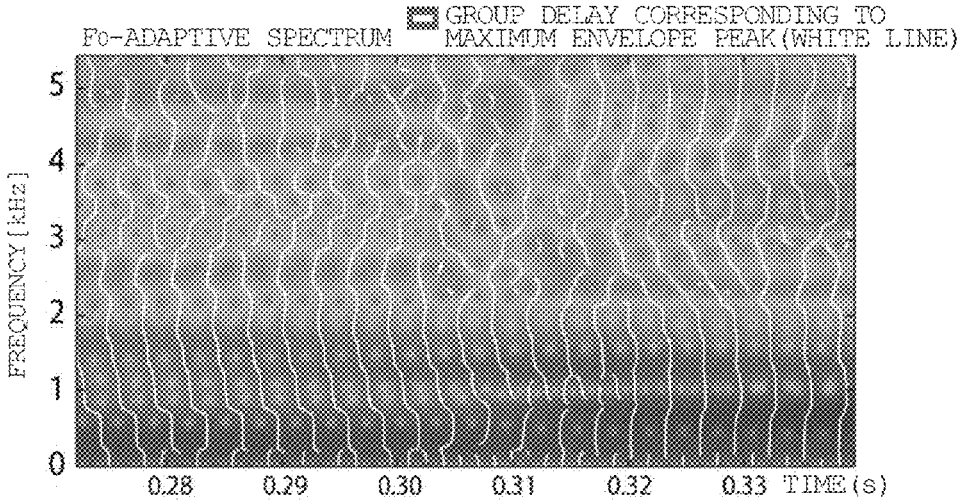

In this embodiment, there is a possibility that group delays are stored for synthesis. Further, with the conventional techniques (Non-Patent Documents 32 and 33), smoothing group delays does not improve the synthesis quality. In contrast therewith, the technique proposed in this disclosure can properly fill in the valleys of the envelope by integrating a plurality of frames. In addition, according to the embodiment of the present invention, more detailed analysis is available beyond the single pitch marking analysis since the group delay resonates at a different time for each frequency band. As shown in FIG. 33, the relationship of the F0-adaptive spectrum with the group delay corresponding to the maximum envelope peak can be known in this embodiment. As can be known by comparing FIG. 33 with FIG. 14, excessive noise (error) caused by the formant frequency fluctuation and the like can be eliminated by detecting the peak at the time of calculating the maximum envelope.

The present invention is not limited to the embodiment described so far. Various modifications and variations fall within the scope of the present invention.

INDUSTRIAL APPLICABILITY

According to the present invention, spectral envelopes and phase information can be analyzed with high accuracy and high temporal resolution from voice and instrument sounds, and high quality sound synthesis can be attained while maintaining the analyzed spectral envelopes and phase information. Further, according to the present invention, audio signals can be analyzed, regardless of the difference in sound kind, without needing additional information such as the pitch marks [time information indicating a driving point of waveform (and the time of analysis) in analysis synchronized with frequency, the time of excitation of a glottal sound source, or the time at which the amplitude in the fundamental period] and phoneme information.

REFERENCE SIGN LIST

1 Estimation System
2 Synthesis System
3 Fundamental Frequency Estimation Section
5 Amplitude Spectrum Acquisition Section
7 Group Delay Extraction Section
9 Spectral Envelope Integration Section
11 Group Delay Integration Section
13 Memory
15 Reading Section
17 Conversion Section
19 Unit Waveform Generation Section
21 Synthesis Section
23 Discontinuity Suppression Section
25 Compensation Section

The invention claimed is:

1. An estimation system of spectral envelopes and group delays for sound analysis and synthesis comprising at least one processor operable to function as:

a fundamental frequency estimation section configured to estimate F0s from an audio signal at all points of time or at all points of sampling;

an amplitude spectrum acquisition section configured to divide the audio signal into a plurality of frames, centering on each point of time or each point of sampling, by using a window having a window length changing with F0 at each point of time or each point of sampling, to perform Discrete Fourier Transform (DFT) analysis on the plurality of frames of the audio signal, and thus to acquire amplitude spectra at the respective frames;

a group delay extraction section configured to extract group delays as phase frequency differentials at the respective frames by performing a group delay extraction algorithm accompanied by DFT analysis on the plurality of frames of the audio signal;

a spectral envelope integration section configured to obtain overlapped spectra at a predetermined time interval by overlapping the amplitude spectra corresponding to the frames included in a certain period determined based on a fundamental period of F0, and to average the overlapped spectra to sequentially obtain a spectral envelope for sound synthesis; and a group delay integration section configured to select a group delay corresponding to a maximum envelope for each frequency component of the spectral envelope from the group delays at a predetermined time interval, and to integrate the thus selected group delays to sequentially obtain a group delay for sound synthesis.

2. The estimation system of spectral envelopes and group delays for sound analysis and synthesis according to claim 1, wherein:

the fundamental frequency estimation section is configured to identify voiced segments and unvoiced segments in addition to the estimation of F0s and to interpolate the unvoiced segments with F0 values of the voiced segments or allocate predetermined values to the unvoiced segments as F0.

3. The estimation system of spectral envelopes and group delays for sound analysis and synthesis according to claim 1, wherein:

the spectral envelope integration section is configured to obtain the spectral envelope for sound synthesis by calculating a mean value of the maximum envelope and a minimum envelope of the overlapped spectra.

4. The estimation system of spectral envelopes and group delays for sound analysis and synthesis according to claim 3, wherein:

the spectral envelope integration section is configured to obtain the spectral envelope for sound synthesis by using, as the mean value, a median value of the maximum envelope and the minimum envelope of the overlapped spectra.

5. The estimation system of spectral envelopes and group delays for sound analysis and synthesis according to claim 4, wherein:

the maximum envelope is transformed to fill in valleys of the minimum envelope and a transformed minimum envelope thus obtained is used as the minimum envelope in calculating the mean value.

6. The estimation system of spectral envelopes and group delays for sound analysis and synthesis according to claim 3, wherein:

the maximum envelope is transformed to fill in valleys of the minimum envelope and a transformed minimum envelope thus obtained is used as the minimum envelope in calculating the mean value.

7. The estimation system of spectral envelopes and group delays for sound analysis and synthesis according to claim 3, wherein:

the spectral envelope integration section is configured to obtain the spectral envelope for sound synthesis by replacing amplitude values of the spectral envelope of frequency bins under F0 with an amplitude value of the spectral envelope at F0.

8. The estimation system of spectral envelopes and group delays for sound analysis and synthesis according to claim 7, further comprising:

a two-dimensional low-pass filter operable to filter the replaced spectral envelope.

9. The estimation system of spectral envelopes and group delays for sound analysis and synthesis according to claim 1, wherein:

the group delay integration section is configured to store, by frequency, the group delays in the frames corresponding to the maximum envelopes for respective frequency components of the overlapped spectra, to compensate a time-shift of analysis of the stored group delays, and to normalize the stored group delays for use in sound synthesis.

10. The estimation system of spectral envelopes and group delays for sound analysis and synthesis according to claim 9, wherein:

the group delay integration section is configured to obtain the group delay for sound synthesis by replacing values of group delay of frequency bins under F0 with a value of the group delay at F0.

11. The estimation system of spectral envelopes and group delays for sound analysis and synthesis according to claim 10, wherein:

the group delay integration section is configured to smooth the replaced group delays for use in sound synthesis.

12. The estimation system of spectral envelopes and group delays for sound analysis and synthesis according to claim 11, wherein:

in smoothing the replaced group delays for use in sound synthesis, the replaced group delays are converted with sin function and cos function to remove discontinuity due to the fundamental period, the converted group delays are subsequently filtered with a two-dimensional low-pass filter, and then the filtered group delays are converted to an original state with $\tan^{-1}$ function for use in sound synthesis.

13. An audio signal synthesis system using the spectral envelopes and group delays for sound analysis and synthesis estimated by the estimation system according to claim 1, the audio signal synthesis system comprising at least one processor operable to function as:

a reading section configured to read out, in a fundamental period for sound synthesis, the spectral envelopes and group delays for sound synthesis from a data file of the spectral envelopes and group delays for sound synthesis estimated by the estimation system, wherein the fundamental period for sound synthesis is a reciprocal of the fundamental frequency for sound synthesis;

a conversion section configured to convert the read-out group delays into phase spectra;

a unit waveform generation section configured to generate unit waveforms based on the read-out spectral envelopes and the phase spectra; and a synthesis section configured to output a synthesized audio signal obtained by performing overlap-add calculation on the generated unit waveforms in the fundamental period for sound synthesis.

14. The audio signal synthesis system according to claim 13, further comprising:

a discontinuity suppression section configured to suppress an occurrence of discontinuity of the read-out group delays along a time axis in a low frequency range before the conversion section converts the read-out group delays.

15. The audio signal synthesis system according to claim 14, wherein:

the discontinuity suppression section is configured to smooth group delays in the low frequency range after adding an optimal offset to the group delay for each voiced segment.

16. The audio signal synthesis system according to claim 15, further comprising:

a compensation section configured to multiply the respective group delays by the fundamental period for sound synthesis as a multiplier coefficient after the conversion section converts the group delays or before the discontinuity suppression section suppresses the discontinuity.

17. The audio signal synthesis system according to claim 15, wherein:

in smoothing the group delays, the read-out group delays are converted with sin function and cos functions to remove discontinuity due to the fundamental period for sound synthesis, the converted group delays are subsequently filtered with a two-dimensional low-pass filter, and then the filtered group delays are converted to an original state with $\tan^{-1}$ function for use in sound synthesis.

18. The audio signal synthesis system according to claim 14, further comprising:

a compensation section configured to multiply the respective group delays by the fundamental period for sound synthesis as a multiplier coefficient after the conversion section converts the group delays or before the discontinuity suppression section suppresses the discontinuity.

19. The audio signal synthesis system according to claim 13, wherein:

the synthesis section is configured to convert an analysis window into a synthesis window and perform overlap-add calculation in the fundamental period on compensated unit waveforms obtained by windowing the unit waveforms by the synthesis window.

20. An estimation method of spectral envelopes and group delays for sound analysis and synthesis implemented on at least one processor, the method comprising:

a fundamental frequency estimation step of estimating F0s from an audio signal at all points of time or at all points of sampling;

an amplitude spectrum acquisition step of dividing the audio signal into a plurality of frames, centering on each point of time or each point of sampling, by using a window having a window length changing with F0 at each point of time or each point of sampling; performing Discrete Fourier Transform (DFT) analysis on the plurality of frames of the audio signal; and thus acquiring amplitude spectra at the respective frames;

a group delay extraction step of extracting group delays as phase frequency differentials at the respective frames by performing a group delay extraction algorithm accompanied by DFT analysis on the plurality of frames of the audio signal;

a spectral envelope integration step of obtaining overlapped spectra at a predetermined time interval by overlapping the amplitude spectra corresponding to the frames included in a certain period determined based on a fundamental period of F0, and averaging the overlapped spectra to sequentially obtain a spectral envelope for sound synthesis; and a group delay integration step of selecting a group delay corresponding to a maximum envelope for each frequency component of the spectral envelope from the group delays at a predetermined time interval, and integrating the thus selected group delays to sequentially obtain a group delay for sound synthesis.

* * * * *